US011486634B2

(12) United States Patent
Kim

(10) Patent No.: US 11,486,634 B2
(45) **Date of Patent: *Nov. 1, 2022**

(54) REFRIGERATOR

(71) Applicant: LG Electronics Inc., Seoul (KR)

(72) Inventor: Jeonggil Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/384,464

(22) Filed: Jul. 23, 2021

(65) Prior Publication Data

US 2021/0348835 A1 Nov. 11, 2021

Related U.S. Application Data

(63) Continuation of application No. 16/791,950, filed on Feb. 14, 2020, now Pat. No. 11,073,331, which is a (Continued)

(30) Foreign Application Priority Data

Mar. 26, 2018 (KR) ..... 10-2018-0034741

(51) Int. Cl.
*F25D 29/00* (2006.01)
*F25D 23/02* (2006.01)
(Continued)

(52) U.S. Cl.
CPC ..... *F25D 29/003* (2013.01); *A47B 88/50* (2017.01); *E05B 65/005* (2013.01);
(Continued)

(58) Field of Classification Search
CPC ..... F25D 29/003; F25D 23/21; F25D 23/028; F25D 23/025; F25D 23/069;
(Continued)

(56) References Cited

U.S. PATENT DOCUMENTS 6,109,708 A 8/2000 Walla et al.
6,450,596 B1 9/2002 Lee
(Continued)

FOREIGN PATENT DOCUMENTS

CN 107524352 12/2017
DE 9320014 2/1994
(Continued)

OTHER PUBLICATIONS

Extended European Search Report in European Application No. 18215048.2, dated Jul. 10, 2019, 10 pages.
(Continued)

*Primary Examiner* — Daniel J Rohrhoff
(74) *Attorney, Agent, or Firm* — Fish & Richardson P.C.

(57) ABSTRACT

A refrigerator includes: a cabinet; an upper door; a lower door that is a drawer type door; a draw-out rail that connects the lower door to a storage space in the cabinet and that guides insertion and withdrawal of the lower door in a front-rear direction; an elevation assembly that is located in the lower door, that elevates an object stored in the lower door in a state in which the lower door is withdrawn, and that elevates the object relative to the lower door; and a door restriction device configured to selectively restrict an opening movement of the upper door based on whether the lower door is opened or closed. The door restriction device is configured to restrict the opening movement of the upper door based on the lower door being opened, and to allow the opening movement of the upper door based on the lower door being closed.

20 Claims, 27 Drawing Sheets

Related U.S. Application Data continuation of application No. 16/236,843, filed on Dec. 31, 2018, now Pat. No. 10,598,428.

(51) Int. Cl.

| | |
|---|---|
| ***F25D 25/02*** | (2006.01) |
| ***E05B 65/00*** | (2006.01) |
| ***A47B 88/50*** | (2017.01) |
| ***E05C 7/06*** | (2006.01) |
| ***F25D 25/04*** | (2006.01) |
| ***F25D 23/06*** | (2006.01) |
| ***A47B 88/90*** | (2017.01) |

(52) U.S. Cl.

CPC ..... *E05B 65/0042* (2013.01); *E05C 7/06* (2013.01); *F25D 23/021* (2013.01); *F25D 23/028* (2013.01); *F25D 25/025* (2013.01); *A47B 2088/901* (2017.01); *A47B 2210/175* (2013.01); *F25D 23/069* (2013.01); *F25D 25/04* (2013.01); *F25D 29/006* (2013.01); *F25D 2323/024* (2013.01); *F25D 2325/021* (2013.01); *F25D 2700/02* (2013.01)

(58) Field of Classification Search

CPC . F25D 200/02; A47B 88/50; A47B 2088/901; A47B 2210/175

See application file for complete search history.

(56) References Cited

U.S. PATENT DOCUMENTS

| | | | | |
|---|---|---|---|---|
| 6,523,919 | B1 * | 2/2003 | Israelsen | B42F 17/08 312/310 |
| 7,533,947 | B2 * | 5/2009 | Kim | F25D 25/025 312/402 |
| 7,628,461 | B2 * | 12/2009 | Carden | F25D 25/04 312/402 |
| 7,810,891 | B2 * | 10/2010 | Lee | F25D 25/025 312/402 |
| 8,827,390 | B2 * | 9/2014 | Wehner | F25D 23/028 312/405.1 |
| 9,107,494 | B2 * | 8/2015 | Scheuring | F25D 25/025 |
| 10,598,428 | B2 * | 3/2020 | Kim | E05B 65/0042 |
| 11,073,331 | B2 * | 7/2021 | Kim | F25D 23/028 |
| 2006/0021373 | A1 * | 2/2006 | Oh | F25D 25/025 62/407 |
| 2006/0043849 | A1 * | 3/2006 | Oh | F25D 25/025 312/310 |
| 2006/0196198 | A1 * | 9/2006 | Kim | A47B 51/00 62/131 |
| 2008/0018215 | A1 | 1/2008 | Carden et al. | |
| 2009/0193836 | A1 * | 8/2009 | Ertz | F25D 25/025 62/449 |
| 2014/0265797 | A1 | 9/2014 | Scheming et al. | |
| 2017/0362864 | A1 | 12/2017 | Fazi | |

FOREIGN PATENT DOCUMENTS

| | | |
|---|---|---|
| JP | H06121717 | 5/1994 |
| KR | 20060019121 | 3/2006 |
| KR | 1020060053420 | 5/2006 |
| KR | 1020060106283 | 10/2006 |
| KR | 1020080101335 | 11/2008 |

OTHER PUBLICATIONS

Chinese Office Action in Chinese Appln. No. 201910157237.3, dated Sep. 30, 2020, 15 pages (with English translation).

Office Action in Korean Appln. No. 10-2018-0034741, dated May 30, 2022, 8 pages (with English translation).

* cited by examiner

REFRIGERATOR

CROSS-REFERENCE TO RELATED APPLICATIONS

The present application is a continuation if U.S. application Ser. No. 16/791,950, filed on Feb. 14, 2020, which is a continuation of U.S. application Ser. No. 16/236,843, filed on Dec. 31, 2018, now U.S. Pat. No. 10,598,428, which claims priority under 35 U.S.C. 119 and 35 U.S.C. 365 to Korean Patent Application No. 10-2018-0034741, filed on Mar. 26, 2018. The disclosures of the prior applications are incorporated by reference in their entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer door that is inserted and withdrawn in a drawer type.

Also, the drawer door is often disposed in a lower region of the refrigerator. Thus, when the drawer-type door is disposed in the lower region of the refrigerator, a user has to turn its back to take out a basket or foods in the drawer door. If the basket or the foods are heavy, the user may feel inconvenient to use the basket or may be injured.

In order to solve such a limitation, various structures are being developed in which the drawer door is capable of being elevated.

Representatively, a structure provided with an elevatable storage container on a rear surface of a withdrawable door is disclosed in Korean Patent Publication No. 10-2008-0101335. However, in this structure, a connection portion between the door and the storage container may be exposed, and electrical devices and structures for the elevation may be exposed to cause serious problems of safety in use.

Also, a structure in which a basket is elevated by an operation of a support member provided on a door is disclosed in Korean Patent Publication No. 10-2006-0053420. In this structure, a support member is exposed directly from a rear surface and a bottom surface of the door to cause problems in safety in use.

Particularly, according to the related art, in the structure in which a portion of the door disposed at the lower side is automatically elevated, when the upper door is opened in the state in which the lower door ascends, damage due to an impact may occur.

However, the related art does not disclose a structure for restricting the operation of the upper door according to the operation of the lower door, and thus, there is a limitation that the door is damaged, or the safety of the user is impaired due to the user's inattention.

SUMMARY

Embodiments provide a refrigerator in which a portion within a drawer door, which is withdrawn in a drawer type, is elevated to improve user's convenience in use.

Embodiments also provide a refrigerator in which opening of an upper door is forcibly restricted to secure safety and prevent a door from being damaged.

Embodiments also provide a refrigerator in which an operation of the door for elevation starts, and simultaneously, the other door disposed at an upper side is immediately forcibly restricted.

Embodiments also provide a refrigerator in which a draw-out operation of an upper door is restricted when an operation of elevation of a lower door starts by mechanical restriction without requiring a separate electronic device.

According to one aspect of the subject matter described in this application, a refrigerator includes: a cabinet that defines a storage space; an upper door configured to open and close a first portion of the storage space; a lower door that is located vertically below the upper door and that is a drawer type door configured to open and close a second portion of the storage space and configured to insert into and withdraw from the second portion of the storage space; a draw-out rail that connects the lower door to the storage space and that is configured to guide insertion and withdrawal of the lower door in a front-rear direction; an elevation assembly that is located in the lower door, that is configured to elevate an object stored in the lower door in a state in which the lower door is withdrawn, and that is configured to elevate the object relative to the lower door; and a door restriction device configured to selectively restrict an opening movement of the upper door based on whether the lower door is opened or closed. The door restriction device is configured to restrict the opening movement of the upper door based on the lower door being opened, and to allow the opening movement of the upper door based on the lower door being closed.

Implementations according to this aspect may include one or more of the following features. For example, the refrigerator may further include a partition member that partitions a front end of the storage space and that extends in a horizontal direction to define the first portion and the second portion of the storage space, where the partition member is disposed between the upper door and the lower door. The partition member may be configured to: contact a rear surface of the upper door in a state in which the upper door is closed; and contact a rear surface of the lower door in a state in which the lower door is closed, where the door restriction device is located at the partition member.

In some implementations, the door restriction device includes: a push member that is configured to protrude to a front side of the partition member and that is configured to contact the lower door and to move in forward and rearward directions based on the lower door opening and closing the second portion of the storage space; and a slider that is configured to, based on the push member moving in the rearward direction, move upward and couple to the upper door.

In some implementations, the door restriction device includes: a restriction device case; a push member accommodated in the restriction device case and configured to move in forward and rearward directions in a state in which the push member contacts the lower door; and a slider that is accommodated in the restriction device case and that is configured to, based on the push member moving in the forward and rearward directions, move in a vertical direction to restrict and release the opening movement of the upper door.

In some examples, the door restriction device further includes an elastic member that connects the restriction device case to the push member and that is configured to provide elastic force to the push member. In some examples, the restriction device case is disposed between the upper door and the lower door, where the push member is configured to be pushed in the rearward direction by a rear surface of the lower door. The slider may be configured to, based on the push member being pushed in the rearward direction, contact a bottom surface of the upper door and restrict the opening movement of the upper door.

In some implementations, the upper door is a drawer type door configured to insert into and withdraw from the first portion of the storage space in the front-rear direction, where the upper door includes a door restriction part that protrudes downward from the bottom surface of the upper door and that is configured to couple to the slider in a state in which the upper door is closed.

In some implementations, the restriction device case includes: a push member accommodation part configured to accommodate the push member, the push member accommodation part defining a space that allows the push member to move in the forward and rearward directions; and a slider accommodation part connected to the push member accommodation part in a direction crossing the push member accommodation part, the slider accommodation part defining a space that allows the slider to move in the vertical direction.

In some examples, the restriction device case further includes a movement guide that protrudes from an inner surface of the push member accommodation part and that extends along a front-rear direction, where the push member defines a guide groove that is recessed from at least one side surface of the push member, that is configured to receive the movement guide, and that is configured to guide a movement of the push member.

In some implementations, the push member includes: a first horizontal part configured to insert into and withdraw from the restriction device case and to contact the lower door; a second horizontal part that extends in a direction parallel to the first horizontal part and that is located vertically above the first horizontal part; a first inclined part that connects a rear end of the first horizontal part to a front end of the second horizontal part, the first inclined part being inclined with respect to the first horizontal part; and a second inclined part that extends upward from a rear end of the second horizontal part, the second inclined part being inclined with respect to the second horizontal part. The slider may be configured to move in the vertical direction along the second inclined part.

In some implementations, the slider defines a through-hole configured to receive the second inclined part, the slider including an inner surface that defines the through-hole, that is configured to contact the second inclined part, and that is inclined with respect to the front-rear direction corresponding to an inclination of the second inclined part.

In some implementations, the push member is inclined upward in a rearward direction toward the storage space, where the slider defines a through-hole configured to receive the push member, the slider including an inner surface that defines the through-hole and that is inclined with respect to the front-rear direction corresponding to an inclination of the push member.

In some implementations, the push member includes: an inclined part configured to move in the front-rear direction within the restriction device case, the inclined part being inclined with respect to the front-rear direction; a horizontal extension part that extends from an end of the inclined part toward a rear end of the lower door; a vertical extension part that is bent from an end of the horizontal extension part and that extends to the rear end of the lower door; and a contact part located at an end of the vertical extension part and configured to contact the rear end of the lower door based on the lower door being closed. In some examples, the slider defines a through-hole configured to receive the inclined part, with an inner surface of the through-hole inclined in the front-rear direction to correspond to the inclined part.

In some implementations, the refrigerator further includes: a door detection device that is configured to, based on contacting the lower door, detect whether the lower door is opened or closed, the door detection device being configured to contact the lower door based on the lower door being closed; and an actuator located at a side of the push member and configured to cause the push member to move based on a signal from the door detection device regarding whether the lower door is opened or closed.

In some implementations, the upper door is rotatably coupled to the cabinet and configured to open and close the first portion of the storage space based on rotating relative to the cabinet. In some examples, the partition member partitions the storage space into an upper storage space that is configured to be covered by the upper door, and a lower storage space that is configured to be opened and closed by the lower door.

In some implementations, the lower door includes: a door part configured to open and close a front surface of the second portion of the storage space; and a drawer part located at a rear surface of the door part, the drawer part defining an opening at an upper surface. The elevation assembly may include: a support member located inside of the drawer part and configured to seat the object stored in the lower door; a drawer-side device that is located at each of both side surfaces of the drawer part, that is coupled to each of both sides of the support member, and that is configured to elevate the support member relative to the drawer part; and a door-side device located inside of the door part and configured to provide power to the drawer-side device.

In some examples, the door part is configured to be selectively coupled to and separate from the drawer part, where the drawer-side device includes a drawer connection part configured to couple to the door part. The door-side device may include a door connection part configured to couple to the drawer connection part, where the drawer connection part and the door connection part are configured to connect to each other based on the door part and the drawer part being coupled to each other. The door connection part may be configured to transmit power to the drawer connection part.

In some examples, the door-side device includes: an elevation motor; and a door-side shaft that is configured to be rotated by the elevation motor and that extends to a first side of the elevation motor and a second side of the elevation motor, a rotation speed of the door-side shaft at the first side of the elevation motor being equal to a rotation speed of the door-side shaft at the second side of the elevation motor. The drawer-side device may include: a drawer-side shaft arranged at each of both sides of the drawer part in a direction perpendicular to the door-side shaft, the drawer-side shaft being configured to receive power from the door-side shaft; and an elevation device that is connected to both ends of the support member, that is connected to the drawer-side shaft, and that is configured to elevate the support member.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
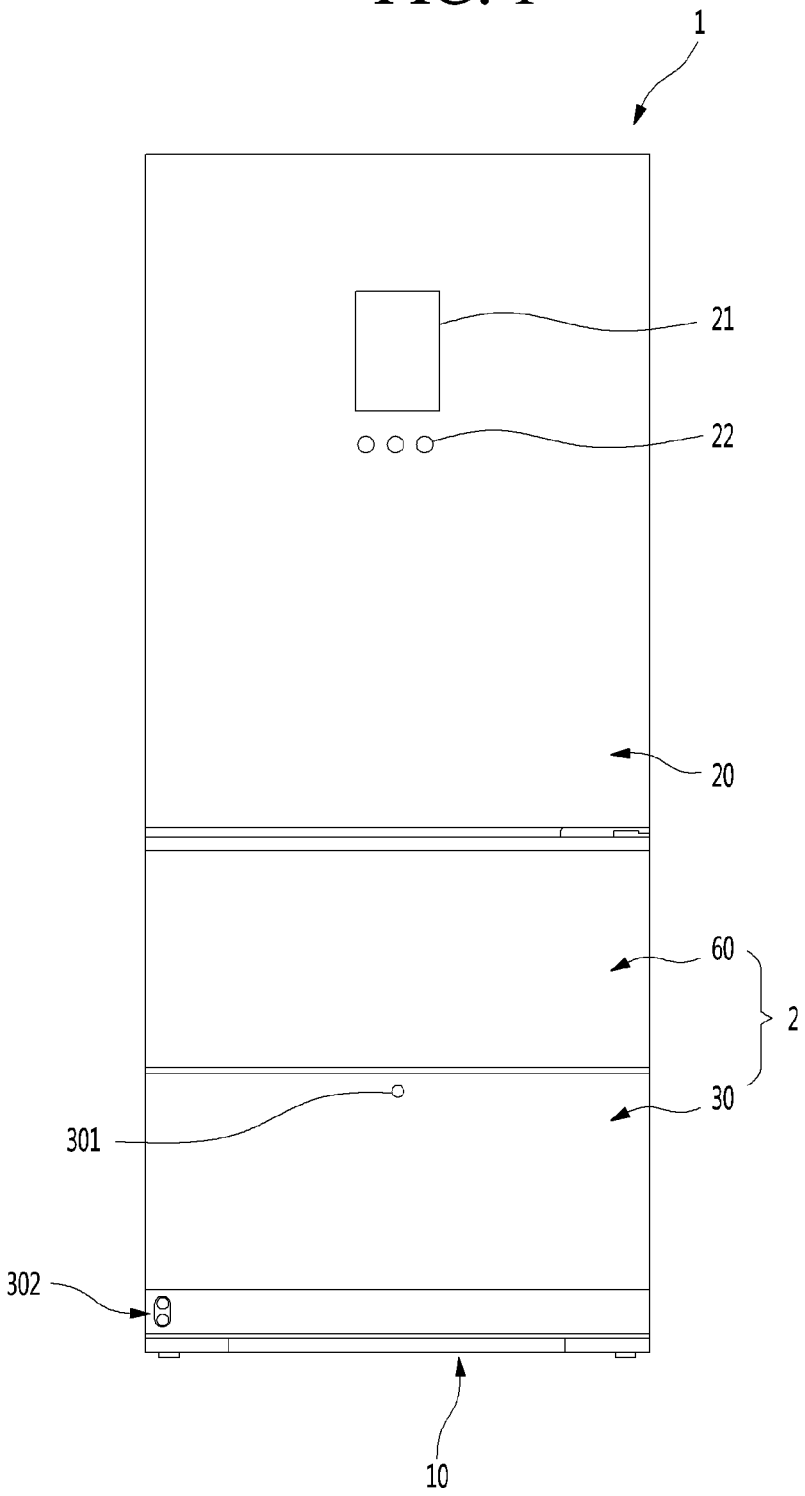
FIG. 1 is a front view of a refrigerator according to an embodiment.
Figure 2:
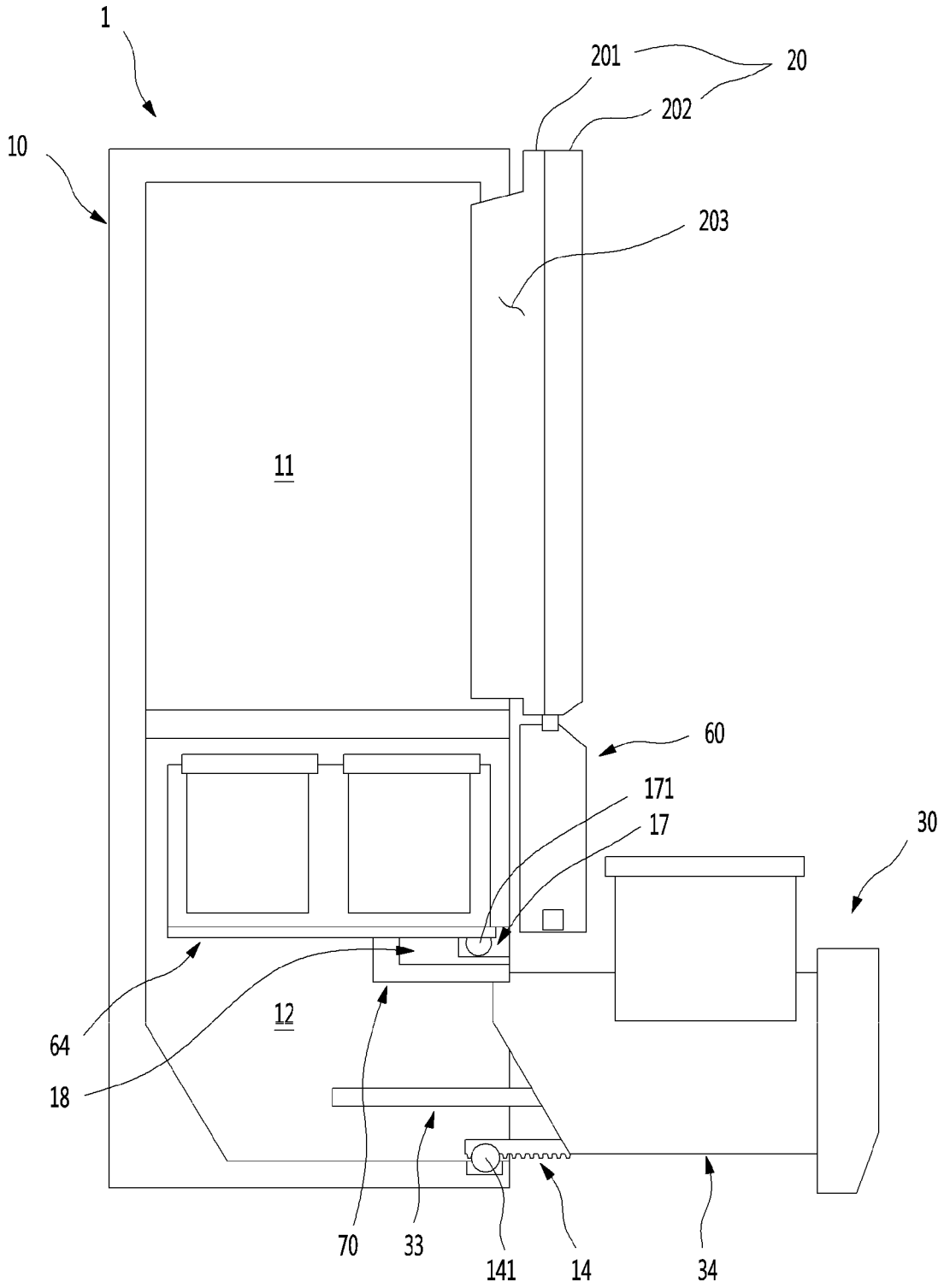
FIG. 2 is a schematic cross-sectional view of the refrigerator.

FIG. 1 is a front view of a refrigerator according to an embodiment. Also, FIG. 2 is a schematic cross-sectional view of the refrigerator.

As illustrated in the drawing, the refrigerator 1 may have an outer appearance that is defined by a cabinet 10 defining a storage space and a door covering an opened front surface of the cabinet 10.

The storage space of the cabinet 10 may be divided into a plurality of spaces. For example, an upper space of the cabinet 10 may be provided as a refrigerating compartment 11, and a lower space of the cabinet 10 may be provided as a freezing compartment 12. Each of the upper space and the lower space may be provided as an independent space that is maintained at a different temperature, except for the refrigerating compartment and the freezing compartment 12. The upper space and the lower space may be called an upper storage space 11 and a lower storage space 12 or a first storage space and a second storage space.

The door may include a rotation door 20 opening and closing the upper storage space 11 through rotation thereof and a drawer door 2 opening and closing the lower storage space 12 by being inserted or withdrawn in a drawer type.

Although the refrigerator in which all of the rotation door 20 and the drawer door 2 are provided is described, the present disclosure is not limited thereto. For example, the present disclosure may be applied to all refrigerators including a door that is inserted and withdrawn in the drawer type.

The rotation door 20 may include a main door 201 and a sub door 202. The main door 201 may be rotatably mounted on the cabinet 10 and may include a separate door accommodation space 203 for accommodating the door at an opened center thereof. A plurality of baskets may be provided in the door accommodation space 203. Also, the sub door 202 may cover an opened front surface of the main door 201. Thus, a user may allow the main door 201 to rotate and thereby to open and close the upper storage space 11 and allow the sub door 202 to rotate and thereby to open and close the door accommodation space 203.

A display 21 may be disposed on one side of a front surface of the rotation door 20. The display 21 may have a liquid crystal display structure or an "88" shape segment structure. Also, when the outer appearance of the door is made of the metal material, a plurality of fine holes are punched in the display 21 to display information by using light passing therethrough.

Also, a manipulation part 22 that is capable of manipulating automatic rotation or withdrawal of the rotation door 20 or the drawer door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 2 or an elevation of a support member 35 within the drawer door.

The drawer door 2 may be provided in the lower storage space 12 and have a structure like a drawer which is capable of being inserted and withdrawn in a front and rear direction. In a state in which the drawer door 2 is withdrawn, the accommodation space that is opened upward may be exposed. Also, a portion of the drawer door 2 may be elevated in the draw-out state, and thus, the food container accommodated in the drawer door 2 may move upward to allow the user to easily lift the food container.

The lower storage space 11 may also be vertically partitioned by the partition member 18. The partition member 18 may extend from a left end to a right end of the lower storage space and may have a predetermined width and thickness. Also, the partition member 18 may divide the whole or a portion of the lower storage space and may be provided only in a portion of the front part so that the partition member 18 contacts the drawer door 2 to seal the drawer door 2.

An upper drawer door 60 and a lower drawer door 30 with respect to the partition member 18 may be provided in the lower storage space. The upper drawer door 60 and the lower drawer door 30 may be withdrawn forward and opened, and the partition member 18 may be provided between the upper drawer door 60 and the lower drawer door 30. When the upper drawer door 60 and the lower drawer door 30 are closed, the upper drawer door 60 and the lower drawer door 30 may contact each other. The upper drawer door 60 may be called an upper door, and the lower drawer door 30 may be called a lower door.

The lower drawer door 30 of the upper drawer door 60 and the lower drawer door 30 may be automatically elevated by user's manipulation. For this, a manipulation part 301 may be provided on the lower drawer door 30. The manipulation part 301 may be provided in a touch or button type. The manipulation part 301 may be provided as a sensor detecting proximity or movement of a user or provided as an input unit that operates by a user's motion or voice.

As illustrated in the drawing, a manipulation device 302 may be disposed on a lower end of the lower drawer door 30 to illuminate an image on a bottom surface and thereby to output a virtual switch and to input an operation in such a manner that the user approaches a corresponding area.

A draw-out motor 14 may be provided on the bottom surface of the lower storage space 12. A draw-out rack 34 coupled to a pinion 141 rotating by the draw-out motor 14 may be provided on the bottom surface of the lower drawer door 30. Thus, the lower drawer door 30 may be automatically inserted and withdrawn according to the manipulation of the manipulation part 301. Also, a food or container within the lower drawer door 30 may be elevated in a state in which the lower drawer door 30 is withdrawn by the manipulation of the manipulation part 301.

That is, the automatic insertion and withdrawal and/or automatic elevation of the lower drawer door 30 may be performed by at least one of a plurality of manipulation devices 22, 301, and 302. As necessary, only one of the plurality of manipulation devices 22, 301, and 302 may be provided.

The lower drawer door 30 may automatically operate continuously in conjunction with the insertion/withdrawal and the elevation thereof or may be configured such that the insertion/withdrawal and elevation operations may respectively operate by the user's manipulation.

Also, the upper drawer door 60 may also be automatically inserted and withdrawn or elevated. For this, the upper draw-out motor 17 may be provided inside the partition member 18, and the upper draw-out rack 64 coupled to the upper pinion 171 may be provided on the bottom surface of the upper drawer door 60.

Hereinafter, the lower drawer door 30 will be described in more detail. The upper drawer door 60 may have the same structure as the lower drawer door 30 and/or the same elevation structure as the lower drawer door 30, and a detailed description thereof will be omitted for the sake of avoiding duplication of description.

Figure 3:
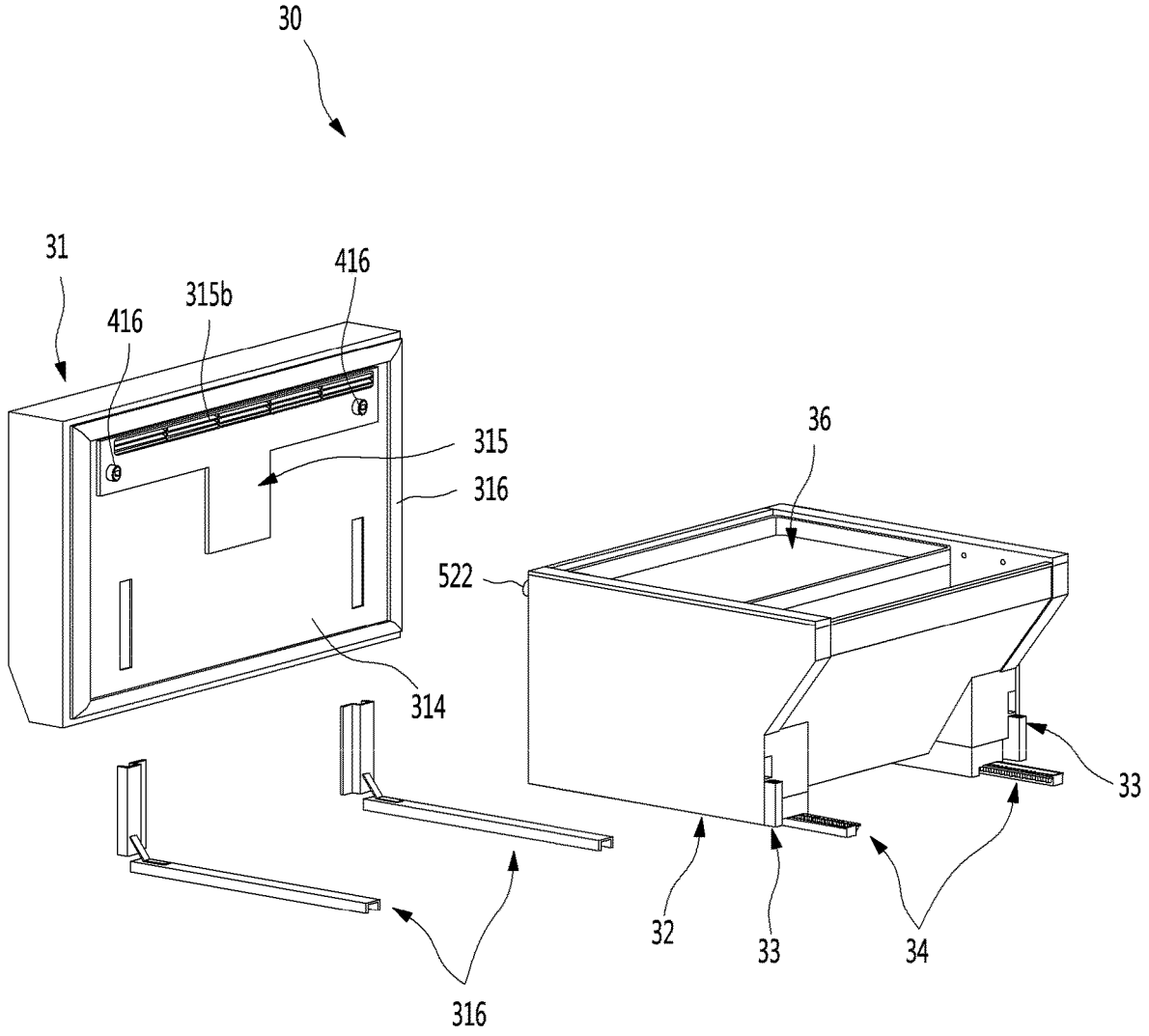
FIG. 3 is an exploded perspective view of a drawer door according to an embodiment.
Figure 4:
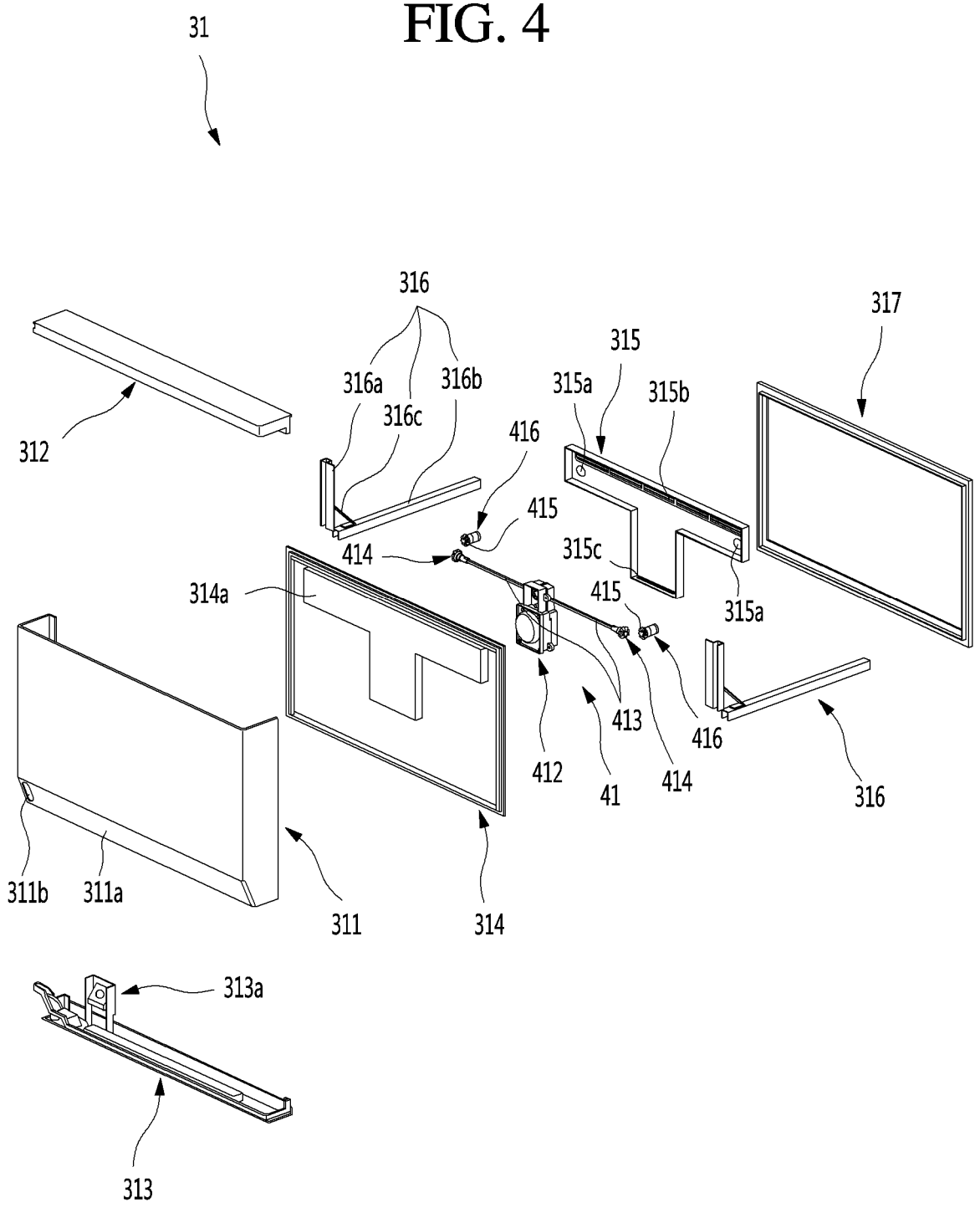
FIG. 4 is an exploded perspective view illustrating a door part of the drawer door.

FIG. 3 is an exploded perspective view of the drawer door according to an embodiment.

As illustrated in the drawings, the lower drawer door 30 may include a door part 31 opening and closing the storage space and a drawer part 32 coupled to a rear surface of the door part 31 and inserted and withdrawn together with the door part 31.

The door part 31 may be exposed to the outside of the cabinet 10 to define an outer appearance of the refrigerator 1, and the drawer part 32 may be disposed inside the cabinet 10 to define an storage space. Also, the door part 31 and the drawer part 32 may be coupled to each other and inserted and withdrawn forward and backward together with each other.

The drawer part 32 may be disposed on the rear surface of the door part 31 to define a space in which the food or container to be stored is accommodated. The inside of the drawer part 32 may have an accommodation space that is opened upward.

In the state in which the lower drawer door 30 is inserted, a machine room 3 in which a compressor and a condenser constituting a refrigeration cycle are provided may be disposed behind the lower drawer door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the lower drawer door 30 may be provided on each of both side surfaces of the drawer part 32. The lower drawer door may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided on the bottom surface of the drawer part 32 and called an under rail.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the lower drawer door 30. That is, when the manipulation parts 22 and 301 are manipulated to be inputted, the draw-out motor 14 may be driven to be inserted and withdrawn. Here, the drawer door 2 may be stably inserted and withdrawn by the draw-out rail 33.

The draw-out rack 34 may not be provided on the drawer part 32. Here, the user may hold a side of the door part 31 to push and pull the door part 31 so that the lower drawer door 30 is directly inserted and withdrawn.

The inside of the drawer part 32 may be divided into a front space S1 and a rear space S2. The support member 35 that is vertically elevated and a container seated on the support member 35 to be elevated together with the support member 35 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the lower drawer door 30 is withdrawn, the entire drawer part 32 may not be withdrawn to the outside of the storage space due to a limitation in draw-out distance of the lower drawer door 30. That is, at least the front space S1 is withdrawn to the outside of the storage space, and the whole or a portion of the rear space S2 is disposed inside the storage space within the cabinet 10.

In such a structure, the draw-out distance of the lower drawer door 30 may be limited by the draw-out rack 34 or the draw-out rail 33. As the draw-out distance becomes longer, the moment applied to the lower drawer door 30 may become larger in the draw-out state, and thus it is difficult to maintain a stable state, and the deformation or damage of the draw-out rail 33 or the draw-out rack 34 may occur.

A support member 35 is accommodated in the front space S1 so that the food or the container 36 seated on the support member 35 is elevated together with the support member 35 is accommodated in the support member 35 while the support member 35 is elevated. Also, constituents 50 for the elevation of the support member 35 may be disposed on both left and right surfaces of the drawer part 32 and be elevated at a center of each of both side surfaces of the support member 35.

A separate drawer cover 37 may be provided in the rear space S2. The front space S1 and the rear space S2 may be partitioned by the drawer cover 37. In a state in which the drawer cover 37 is mounted, front and top surfaces of the rear space S2 may be covered and may not be used. However, when the drawer cover 37 is separated, the user may be accessible to the rear space S2, and thus, foods may be easily accommodated in the rear space S2. To utilize the rear space S2, a separate pocket or a container corresponding to the shape of the rear space may be disposed in the rear space S2.

The door part 31 and the drawer part 32 constituting the lower drawer door 30 may be coupled to be separated from each other. Thus, assembling workability and serviceability may be improved through the separable structure of the door part 31 and the drawer part 32.

A rear surface of the door part 31 and a front surface of the drawer part 32 may be coupled to each other. When the door part 31 and the drawer part 32 are coupled to each other, power for the elevation of the support member 35 may be provided. The elevation assembly 40 for the elevation of the support member 35 may be disposed on each of the door part 31 and the drawer part 32. When the door part 31 and the drawer 32 are coupled to or separated from each other, the elevation assembly may be selectively connected.

For this, the elevation assembly 40 may be constituted by the door-side device 41 disposed in the door part 31 and the drawer-side device 50 disposed in the drawer part 32. The door-side device 41 may be provided in the door part 31, and a door connection member 416 that is one component of the door-side device 41 may be exposed to the rear surface of the door part 31. Also, the drawer-side device 50 may be provided in the drawer part 32, and a drawer connection member 522 disposed at a position corresponding to the door connection member 416 may be exposed to the front surface of the drawer part 32. The door connection member 416 and the drawer connection member 522 may have shapes corresponding to each other and be coupled to be separated from each other. When the door connection member 46 and the drawer connection member 522 are coupled to each other, power may be transmitted. When the door part 31 is fixed to the drawer part 32, the door connection member 416 and the drawer connection member 522 may be coupled to each other. When the door part 31 is separated from the drawer part 32, the door connection member 416 and the drawer connection member 522 may be separated from each other.

Also, an elevation motor 411 serving as a power source of the elevation assembly 40 may be provided in the door part 31. Also, a door cover 315 may be disposed above a space in which the elevation motor 411 is provided. The door cover 315 may be disposed on the rear surface of the door part 31 to cover the door-side device 41 including to the elevation motor 411 provided in the door part 31.

In more detail, the door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, the inside of the door part 31 may be filled with a heat insulating material and may provide a space in which the door-side device 41 constituting a portion of the elevation assembly 40 is mounted.

The outer case 311 may be formed by bending a plate-shaped metal material, and an inclined part 311*a* may be provided on a lower end of a front surface of the outer case 311. A manipulation device hole 311*b* is defined in one side of the inclined part 311*a*, and the manipulation device 302 for detecting an output of a virtual switch and user's manipulation may be mounted in the manipulation device hole 311*b*. The manipulation device 302 may be constituted by a projector light that outputs an image and a proximity sensor. Also, a manipulation part bracket 313*a* for the mounting of the manipulation device 302 and an arrangement of a line connected to electrical components within the door part 31 may be provided in the lower deco 313.

The door liner 314 may be made of a plastic material, and a recess part 314*a* recessed so that the door-side device 41 including the elevation motor 411 is mounted may be provided. The door cover 315 may be mounted on the door liner 314 to cover the door-side device mounted on the door part 31 and the recess part 314*a*.

A connection member hole 315*a* may be defined in the rear surface of the door part 31. The connection member hole 315*a* may be defined in the door cover 315. The door connection member 416 may be exposed to the rear surface of the door part 31 through the connection member hole 315*a*. The door connection member 416 may move forward and backward according to the user's manipulation. When the door part 31 and the drawer part 32 are separated from each other by the user's manipulation, the door connection member 416 and the drawer connection member 522 may be separated from each other.

The door-side device 41 may be provided on the door part 31. The door-side device 41 may be constituents disposed on the door part 31 of the elevation assembly and include a motor assembly 412 constituted by the elevation motor 411 and gears, a door-side shaft rotating by the motor assembly 412, a door-side first gear 414 having a bevel gear shape and disposed on each of both ends of the door-side shaft 413, and a door-side second gear 415 having a bevel gear shape and coupled to the door-side first gear 414 and the door connection member 416. A configuration of each of the constituents of the door-side device 41 will be described below in more detail.

The motor assembly 412 may provide power for elevating the support member 35 and be disposed in parallel to the front surface of the door part 31 to minimize the recessed space inside the door part 31. Also, the door-side shaft 413 connected to both sides of the motor assembly 412 is connected to the elevation motor 411 to rotate at the same time.

The pair of door frames 315 may be disposed on both left and right sides on the rear surface of the door part 31. The door frames 316 may connect the door part 31 to the drawer part 32 so that the drawer part 32 is maintained in the state of being coupled to the door part 31. Also, a gasket 317 contacting the front end of the cabinet 10 to seal the storage space may be disposed around the rear surface of the door liner 314.

Figure 5:
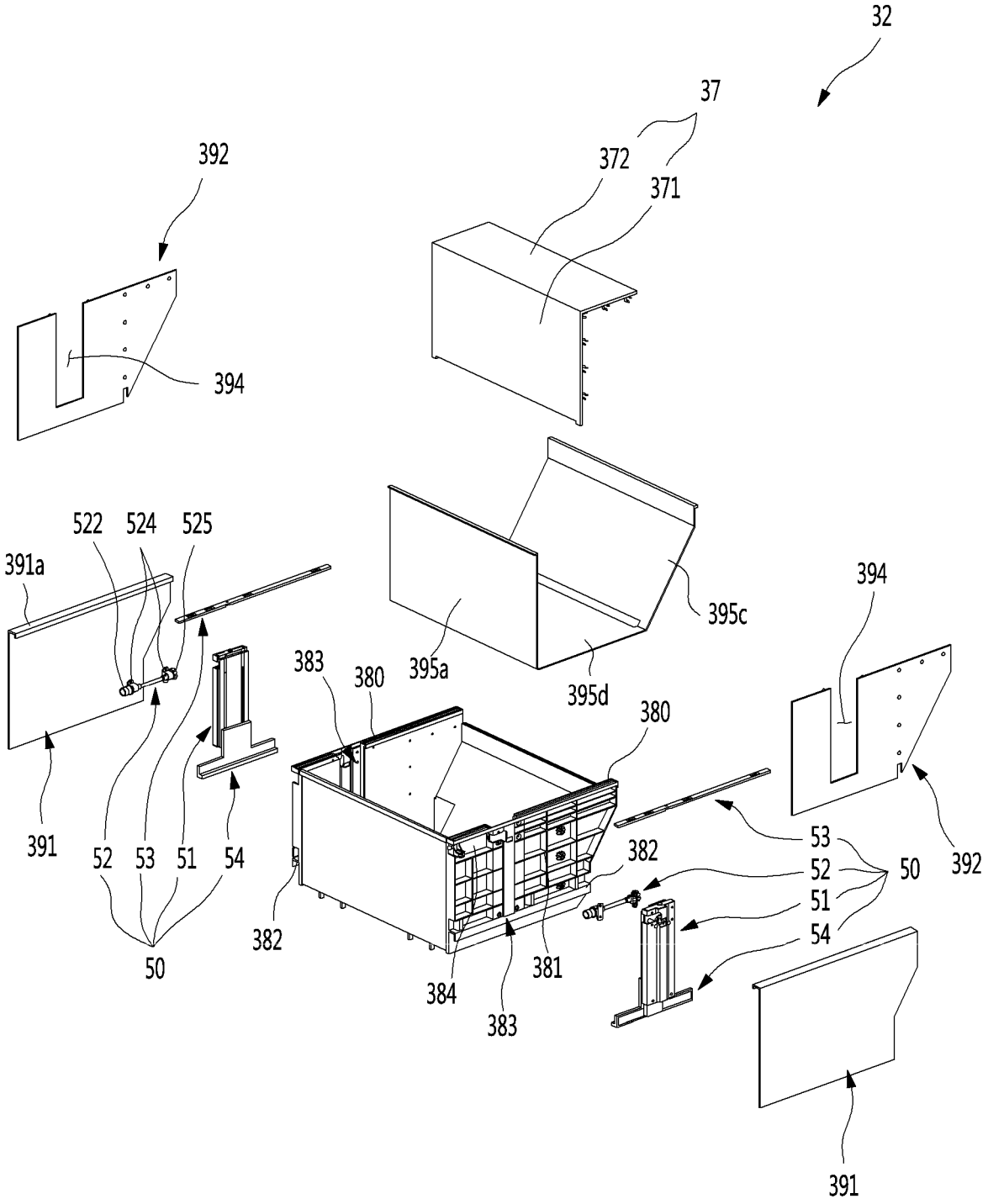
FIG. 5 is an exploded perspective view illustrating a drawer part of the drawer door.

FIG. 5 is an exploded perspective view illustrating the drawer part of the drawer door.

As illustrated in the drawings, the drawer part 32 may include a drawer body 38 defining an entire shape of the drawer part 32, a drawer-side device 50 provided in the drawer body 38 to constitute the elevation assembly 40, and a plurality of plates 391, 392, and 393 defining an outer appearance of the drawer part 32.

In more detail, the drawer body 38 may be injection-molded by using a plastic material and define an entire shape of the drawer part 32. Also, the inner and outer appearances of the drawer part 32 may be defined by the plurality of plates 391, 392, and 395. The drawer body 38 may have a basket shape having an opened top surface to define a food storage space therein.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion is disposed in the storage space.

Also, the draw-out rack 34 may be coupled to a pinion gear 141 disposed on the bottom surface of the storage space. Thus, when the draw-out motor 14 is driven, the pinion gear 141 may rotate to allow the draw-out rack 34 to move, and the lower drawer door 30 may be inserted and withdrawn.

A plurality of reinforcement ribs 381 may extend in vertical and horizontal directions on both left and right sides of the drawer body 38. The reinforcement ribs 381 may prevent the drawer body 38 from being deformed by a load applied to both the left and right surfaces of the drawer body.

Particularly, the elevation device 51, which is a main component for the elevation of the support member 35, may be disposed on both side surfaces of the drawer body 38. Thus, when the support member 35 and the food or container seated on the support member 35 is elevated, a load may be concentrated into both the side surfaces of the drawer body 38. The reinforcement ribs 381 may maintain the shape of the drawer body 38, particularly, the drawer part 32 even under the concentrated load.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated. The draw-out rail 33 may be a rail that extends in multistage. The draw-out rail 33 may have one end fixed to the storage space inside the cabinet 10 and the other end fixed to the rail mounting part 382 to more stably realize insertion and the withdrawal of the lower drawer door 30. The rail mounting portion 382 may be disposed in an inner region of the drawer flange 380, which will be described below, and may be covered by the outer side plate 391.

A mounting part 383 on which the elevation device 51 that is a main component is mounted may be recessed inside both the side surfaces of the drawer body 38. The mounting part 383 may be recessed outward from the inner surface of the drawer body 38 providing the drawer space.

The mounting part 383 may extend in the vertical direction. Here, the mounting part 383 may vertically extend from the upper end of the drawer body 38 to the bottom surface of the drawer body 38. Here, a lower end of the mounting part 383 may be disposed above a lower end of each of both the side surfaces of the drawer body 38. The lower end of the mounting part 383 may extend up to the rail mounting part 382. Thus, the mounting part 382 may not interfere with the draw-out rail 33 and the components for the mounting of the draw-out rail 33.

Also, the inner surface of the mounting part 383 may have a shape corresponding to that of the outer surface of the elevation device 51. Here, in the even state in which the load is applied, the stably mounted state of the elevation device 51 may be maintained.

In detail, the mounting part 383 may be stepped to correspond to the outer side surface of the elevation device 51, and the mounting part 383 may be restricted without rotating in a state in which the elevation device 51 having corresponding shape is mounted. Also, the elevation device 51 may be disposed on the same plane as the inner surface of the drawer body 38 in the state of being mounted on the mounting part 383 to prevent the interference when the support member 35 is elevated and provide a sense of unity.

A mounting part bracket 53 may be disposed on the opened top surface of the mounting part 383. The mounting part bracket 53 may be made of a metal material and restrict the upper end of the elevation device 51.

The elevation device 51 may be connected to both ends of the support member 35 by the connecting bracket 54. Also, the elevation device 51 may operate to allow the support member 35 to vertically move and guide smooth vertical movement of the support member 35.

The shaft mounting part 384 may be opened outward from the upper end of each of both the side surfaces of the drawer body 38 to communicate with the mounting part 383. Thus, the drawer-side shaft 52 mounted on the shaft mounting part 384 may be coupled to the elevation device 51 mounted on the mounting part 383 to transmit the power.

The mounting part 383 and the shaft mounting part 384 may be disposed inside a region of the drawer flange 380 that is bent outward from an upper end of each of both side surfaces of the drawer body 38. That is, the mounting part 383 and the shaft mounting part 384 may be disposed below the region in which the drawer flange 380 is bent outward. Also, in addition to the mounting part 383 and the shaft mounting part 384, the elevation device 51 and the drawer-side shaft 52, which are mounted on the mounting part 383 and the shaft mounting part 384, may not also protrude inward or outward from the drawer flange 380. All of the drawer-side device 50 constituting a portion of the elevation assembly 40 and the structure for mounting the drawer-side device 50 may be disposed in the region of the drawer flange 380. Thus, a loss of the storage space inside the drawer body 38 may be prevented from occurring. Also, the reinforcement rib 381 and the rail mounting part 382 may also be disposed inside the region of the drawer flange 380.

The outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the drawer-side shaft 52 and the draw-out rail 33, which are mounted on both the sides of the drawer body 38 may not be exposed to the outside.

Also, an upper bent part 391*a* may be disposed on an upper end of the outer side plate 391. The upper bent part 391*a* may cover the upper end of each of both the side surfaces of the drawer body 38 and the mounting part bracket 53.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

An extending end of the upper bent part 391*a* may contact the upper end of the inner side plate 391. Thus, all of the inside and outside and the top surface of both the left and right surfaces of the drawer body 38 may be covered by the inner side plate 392 and the outer side plate 391.

Also, a side opening 394 having a size corresponding to the mounting part 383 may be defined in the inner side plate 392. Thus, in the state in which the inner side plate is mounted, the elevation device 51 mounted on the mounting part 383 may be exposed to the inside of the drawer body 38, and since the connecting bracket 54 is mounted, the elevation device 51 may be coupled to the support member 35.

An inner plate 395 may be disposed on each of front, bottom, and rear surfaces of the inside of the drawer body 38. The inner plate 395 may be constituted by a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the storage space within the drawer part 32 may have a metal texture on the whole, and the foods accommodated in the drawer part 32 may be more uniformly cooled and thus stored at a low temperature in the more uniform region. In addition, visually excellent cooling performance and storage performance may be provided to the user.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the support member 35 is disposed, may be exposed in the drawer body 38, and the rear space S2 may be covered by the drawer cover 37.

The support member 35 may be disposed in the drawer body 38. The support member 35 may include one component of the elevation assembly 40. The support member 35 may have a size that is enough to be accommodated in the front space S1 of the bottom surface of the drawer body 38.

Hereinafter, a structure of the elevation assembly will be described in more detail with reference to the accompanying drawings.

Figure 6:
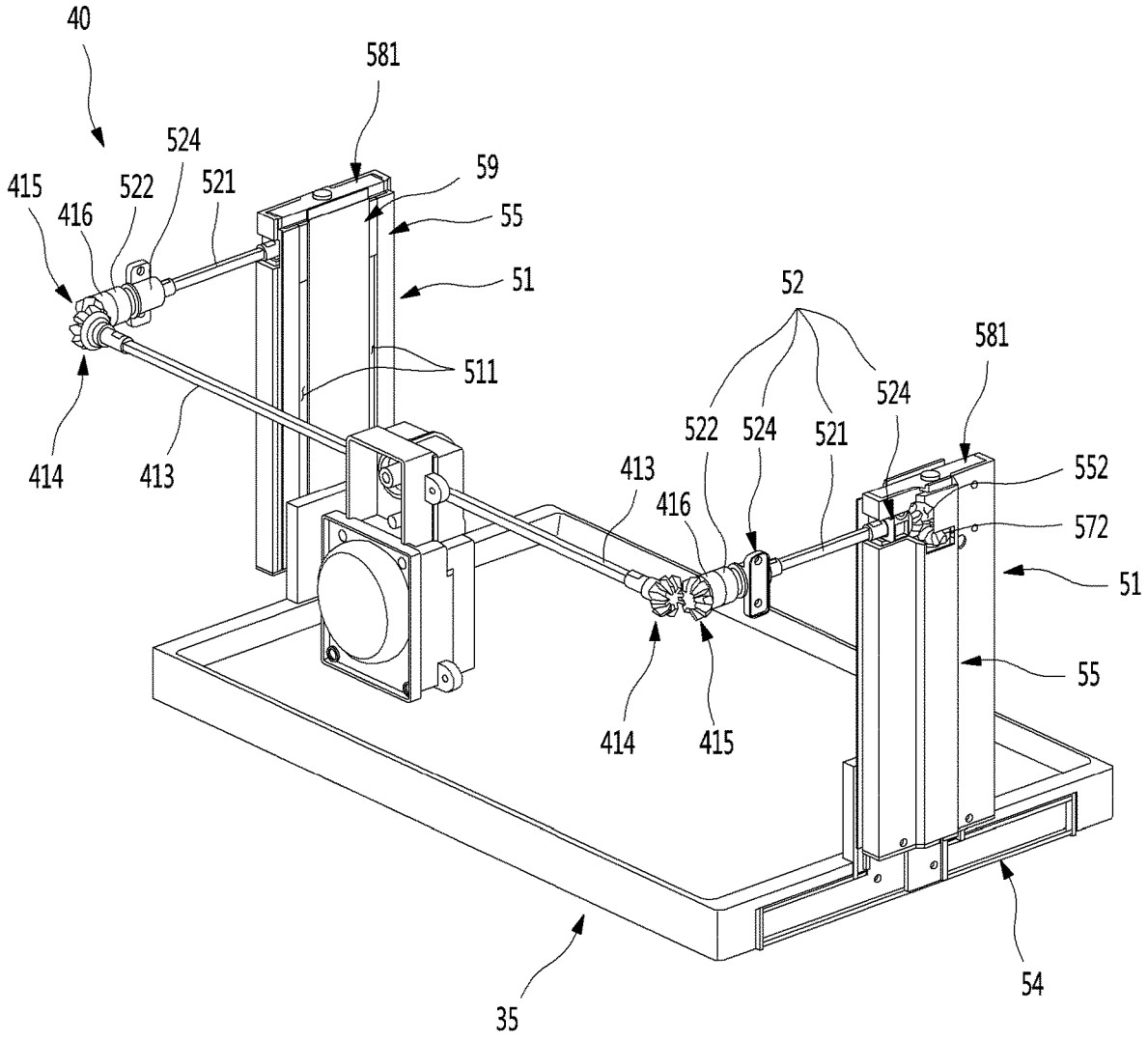
FIG. 6 is a perspective view of an elevation assembly built in the drawer door.
Figure 7:
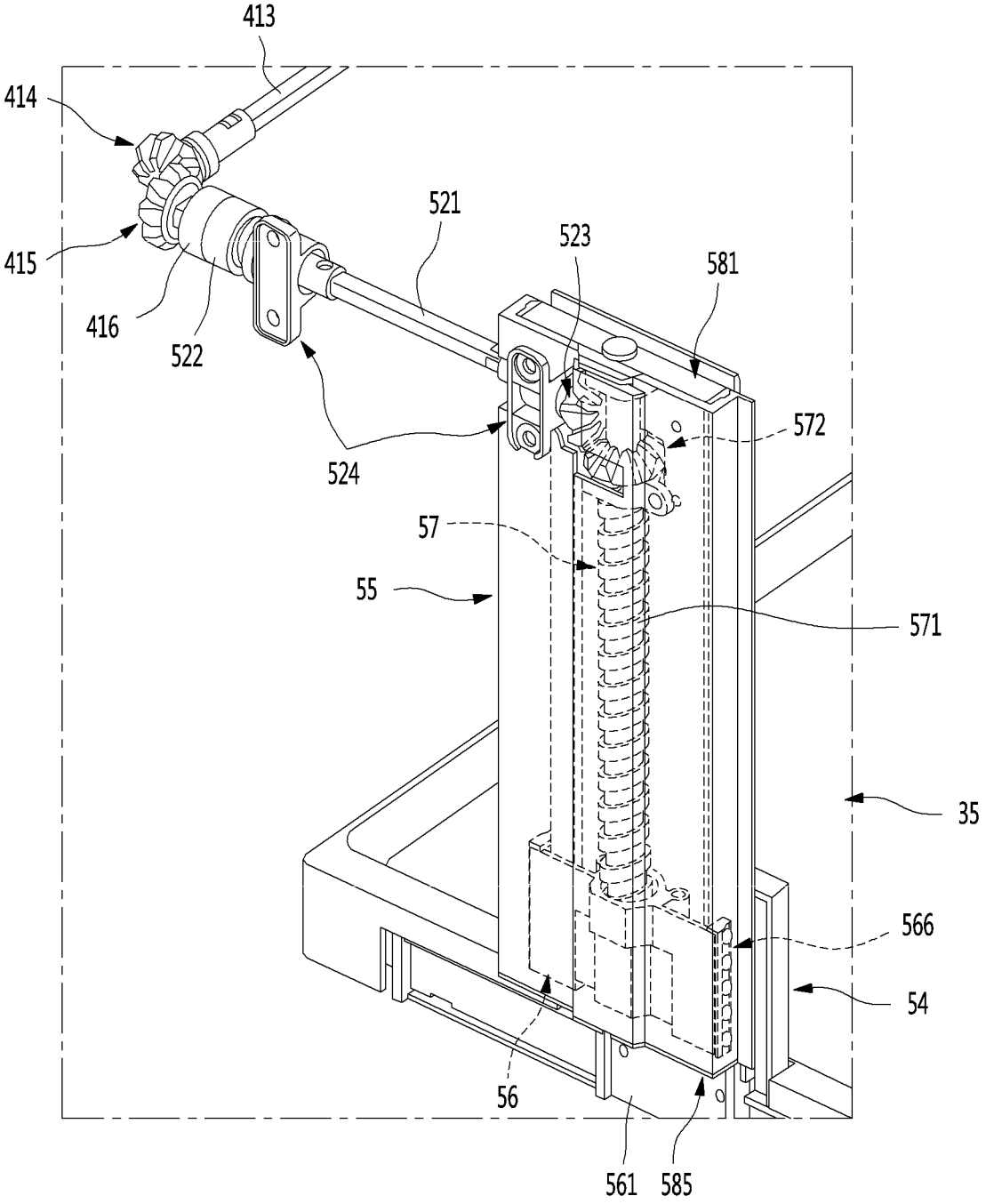
FIG. 7 is a view illustrating a power transmission state of a drawer-side device of the elevation assembly.

FIG. 6 is a perspective view of the elevation assembly built in the drawer door. Also, FIG. 7 is a view illustrating a power transmission state of the drawer-side device of the elevation assembly.

As illustrated in the drawing, the elevation assembly 40 may be constituted by the door-side device disposed in the door part 31 and the drawer-side device 50 disposed in the drawer part 32. Also, the door-side device 41 and the drawer-side device 50 may be coupled to each other by coupling the door part 31 to the drawer part 32 to transmit the power.

As described above, the door-side device 41 may include the motor assembly 412 including the elevation motor 411, the door-side shaft 413 coupled to the motor assembly 412 to rotate, the door-side first gear 414 disposed on each of both the ends of the door-side shaft 413, the door-side second gear 415 engaged with the door-side first gear 414, and the door connection member 416 coupled to the door-side second gear 415.

Since the pair of elevation devices 51 are driven by rotation force transmitted to the pair of door-side second gears 415, the door-side first gear 414 and the door-side second gear 415 may rotate at the same rotation rate and at the same time to prevent the support member 35 from being tilted. For this, the door-side shaft 413 may have a structure in which one shaft or a plurality of shafts passing through the motor assembly 412 rotates together with each other.

The door-side shaft 413 extending to each of both sides may rotate at the same time and at the same rotation number according to the driving of the elevation motor 411. Also, the door-side first gear 414 at the end of the door-side shaft 413 may be gear-coupled in a state of perpendicularly crossing the door-side second gear 415 and be in a state in which power transmission is possible. Thus, the door-side second gear 415 rotating by the door-side first gear 414 may allow the door connection member 416 to rotate, and the drawer connection member 416 coupled to the door connection member 522 may rotate together to transmit the rotation force to the drawer-side device 50.

As a result, the door-side device 41 may be connected to the drawer-side device 50 by the coupling of the door part 31 and the drawer part 32, and the one elevation motor 411 provided in the door part 31 may drive the constituents of the drawer-side device 50, which are provided on both sides of the drawer part 32.

The support member 35 may have a rectangular plate shape. Substantially, the support member 35 may include an elevation plate 351 supporting the food or container and an elevation frame 352 supporting the elevation plate 351 at a lower side and reinforcing strength of the elevation plate 351. The support member 35 may be a portion on which the food or container 36 is substantially seated and supported and thus may be called a seating member or a tray.

The connecting bracket 54 may have one side fixed to the elevation frame 352 and the other side coupled to the elevation device 51. Thus, when the elevation device 51 operates, the elevation frame 352 connected to the connecting bracket 54, i.e., the support member 35 may vertically move together with the connecting bracket 54.

The drawer-side device 50 disposed in the drawer body 38 of the elevation assembly 40 may be mounted in the drawer body 38. The drawer-side device 50 may include the support member 35, the elevation device 51 disposed on each of both the sides of the support member 35 and mounted inside the mounting part 383, the connecting bracket 54, the drawer-side shaft 52, and the mounting part bracket 53 restricting the elevation device 51.

When the motor assembly 412 is driven, the rotation force of the door-side shaft 413 may be transmitted to the drawer-side device 50 by the door connection member 416 and the drawer connection member 522, which are coupled to each other. When the drawer-side shaft 52 rotates by the rotation of the drawer connection member 522, the elevation shaft 57 inside the elevation device 51 coupled to the drawer-side shaft 52 rotates.

A block holder coupled to the elevation shaft 57 may vertically move through the rotation of the elevation shaft 57. The block holder 56 may be coupled to the connecting bracket 54 to elevate the connecting bracket 5, and the connecting bracket 54 disposed each of both the left and right sides may elevate the support member 35 in the state of being coupled to the elevation frame 352.

That is, the rotation force of the motor assembly 412 may be transmitted to the drawer-side shaft 52 through the door-side shaft 413 to allow the elevation shaft 57 to rotate. The block holder 56 and the connecting bracket 54 may guide the support member 35 to move vertically.

In details of the vertical movement of the support member 35 and the constituents of the drawer-side device 50, the drawer-side shaft 52 may include the elevation device 51 for the vertical movement of the support member 35, the drawer-side shaft 52 connected to the elevation device 51 and the door-side device 41 to transmit the power, and the connecting bracket 54 connected to the elevation device 51 and the support member 35.

The arranged position of the elevation device 51 may be a position corresponding to a center of the front space S1 in the front and rear direction and be disposed at a position corresponding to a central portion of each of both the side surfaces of the support member 35. Thus, the support member 35 may be stably elevated without being tilted.

The elevation device 51 may include the rail housing 55 mounted on the mounting part 383 to define the inner space, the upper and lower caps 581 and 585 covering the upper and lower ends of the housing 55 and the block holder 56, which move along the elevation shaft 57 within the housing 55, and the rail cover 59 covering the opened one surface of the housing 55.

The rail housing 55 and the rail cover 59 may include a pair of guide slits 511 extending in the vertical direction. The elevation block 567 and the block holder 56 may be elevated along the pair of guide slits 511.

Also, the rail housing 55 may be made of a plate-shaped metal material and have a protruding central portion. Here, both side ends of the central portion may extend to be stepped. Also, the rail housing 55 may provide a space in which the elevation shaft 57 and the block holder 56 are accommodated.

Particularly, an inner space of the rail housing 55 may provide a space in which both ends of the block holder 56 are accommodated, and a central portion of the block holder 56 may protrude through a housing opening 551 that is opened in the rail housing 55. Also, the block holder 56 may move along the housing opening 551.

A shaft insertion hole 552 into which an end of the drawer-side shaft 52 extending to the elevation device 51 is accommodated may be defined in the upper end of the rail housing 55. The shaft insertion hole 552 may be opened in a shape corresponding so that the end of the drawer shaft 521 and the drawer-side gear 523 are inserted, i.e., may be opened to be exposed up to a portion of the elevation shaft 57 coupled to the upper end of the elevation shaft 57. Thus, the drawer-side shaft 52 may be mounted through the shaft insertion hole 552, and also, the coupled state between the drawer-side gear 523 and the shaft gear 572 may be confirmed.

The elevation shaft 57 may be accommodated in the rail housing 55 and disposed at the central portion 553. Also, a screw thread 4571 may be provided on an outer circumferential surface of the elevation shaft 57 so that the elevation block 567 vertically moves along the elevation shaft 57 when the elevation shaft 57 rotates.

The elevation shaft 57 may vertically extend inside the rail housing 55, and upper and lower ends of the elevation shaft 57 may be rotatably supported inside the rail housing 55. Also, the screw thread 571 may be disposed between the upper and lower ends of the elevation shaft 57.

Also, a shaft gear 572 may be disposed on an upper portion of the elevation shaft 57, i.e., an upper end of the screw thread 571. The shaft gear 572 may be disposed on an upper end of the screw thread 571 and be integrally coupled to the elevation shaft 57 to rotate together with the elevation shaft 57. Also, the shaft gear 572 may be gear-coupled to the drawer-side shaft 52 in the state of perpendicularly crossing the drawer-side gear 523 mounted on the drawer-side shaft 52.

The block holder 56 may pass through the central portion of the shaft gear 572. The shaft gear 572 may have a shape corresponding to the inner space of the rail housing 55 so as to be guided vertically move along the rail housing 55 when the elevation shaft 57 rotates.

The outer shape of the block holder 56 may correspond to the inner shape of the rail housing 55. Particularly, the central portion of the block holder 56 may protrude and be inserted into the central portion of the rail housing 55. Both side surfaces of the block holder 56 may protrude laterally and be accommodated in both inner side surfaces of the rail housing 55. Also, the inner surface of the block holder 56 may protrude through the housing opening 551 and be exposed to the inside of the drawer part 32 so as to be coupled to the support member 35 or the connecting bracket 54.

As described above, the outer shape of the block holder 56 and the inner shape of the rail housing 55 corresponding to the outer shape of the block holder 56 may be formed in multistage or in a stepped shape. When the support member 35 is elevated, it may be possible to effectively distribute and support the load applied to the elevation direction or the forward and backward direction, thereby realizing the stable elevation.

Also, a rolling member 568 constituted by a plurality of ball bearings arranged in the vertical direction may be provided on both sides of the block holder 56. The rolling member 568 may be disposed between both side surfaces of the block holder 56 and the inner surface of the elevation device 50 to smoothly elevate the block holder 56.

That is, the block holder 56 may move upward and downward by the rotation of the elevation shaft 57, and the block holder 56 may be connected to the support member to provide power for the elevation of the support member 35. Simultaneously, the elevation device 50 may be configured such that the block holder 56 having a multistage shape is guided along the elevation device from the inside of the elevation device 50 to guide the vertical movement of the support member 35.

A hollow space may be defined in the inside of the block holder 56, and the rail cover 59 may be accommodated in the inside of the block holder 56. Also, the block holder 56 may vertically move along the guide slit 511 defined by the rail cover 59 and the rail housing 55.

The rail cover 59 may cover the housing opening 551 and define the guide slit 511. In detail, the rail cover 59 may be made of a plate-shaped metal material like the inner side plate 392.

The rail cover 59 may cover the housing opening 551 to cover the constituents accommodated in the rail housing 55. For this, the rail cover 59 may be disposed in the housing opening 551. Each of both ends of the rail cover may be bent to the inside of the rail housing 55 and then bent outward to form the guide slit 511. Also, the block holder 56 may vertically move along the guide slit 511.

The rail cover 59 may have a cross-sectional shape corresponding to the hollow shape within the block holder 56 to pass through the hollow of the block holder 56. Thus, the block holder 56 may vertically move in a state of being penetrated by the rail cover 59.

Also, the rail cover 59 exposed to the inside of the housing opening 551 may have a horizontal width less than that of the housing opening 551. That is, the guide slit 511 that vertically extends may be defined when the rail cover 59 is mounted.

Also, a distance between both ends of the rail cover 59 inside the rail housing 55 may be greater than a size of the housing opening 551. Most of the inner surface of the drawer part 32, on which the elevation device 51 is mounted, except for the gap by the guide slit 511 may be covered by the metal material to improve the outer appearance thereof.

The drawer-side shaft 52 may be disposed on the shaft mounting part 384. The drawer shaft 52 may include the drawer shaft 52, the drawer connection member 522 at the front end of the drawer shaft 521, the drawer gear 523 at the rear end of the drawer shaft 521, and the shaft fixing member allowing the drawer shaft 521 to rotate and fixed to the shaft mounting part 384.

In detail, the drawer connection member 522 may be coupled to the front end of the drawer shaft 521, and the drawer connection member 522 may be exposed to both side surfaces of the front surface of the drawer part 32. Also, as described above, the drawer connection member 522 may be coupled to the door connection member 416 when the door part 31 and the drawer part are coupled to each other and may rotate together with the driving of the door-side device 41.

Also, the drawer-side gear 523 may be disposed on the rear end of the drawer shaft 521. The drawer-side gear 523 may have a bevel gear shape and be coupled to the shaft gear 572 through the rail housing 55. That is, the drawer-side shaft 52 and the elevation shaft 57, which are disposed to perpendicularly cross each other, may be connected to each other by the drawer-side gear 523 and the shaft gear 572 to transmit the power.

Also, the shaft fixing member 524 may be disposed on the drawer-side shaft 52. The shaft fixing member 524 may be provided in a pair on both left and right sides to support the drawer-side shaft 52 so that the drawer-side shaft 52 is rotatable without being tilted or moving.

Hereinafter, a state in which the drawer door 2 of the refrigerator 1 is inserted and withdrawn and is elevated according to an embodiment will be described in more detail with reference to the accompanying drawings.

Figure 8:
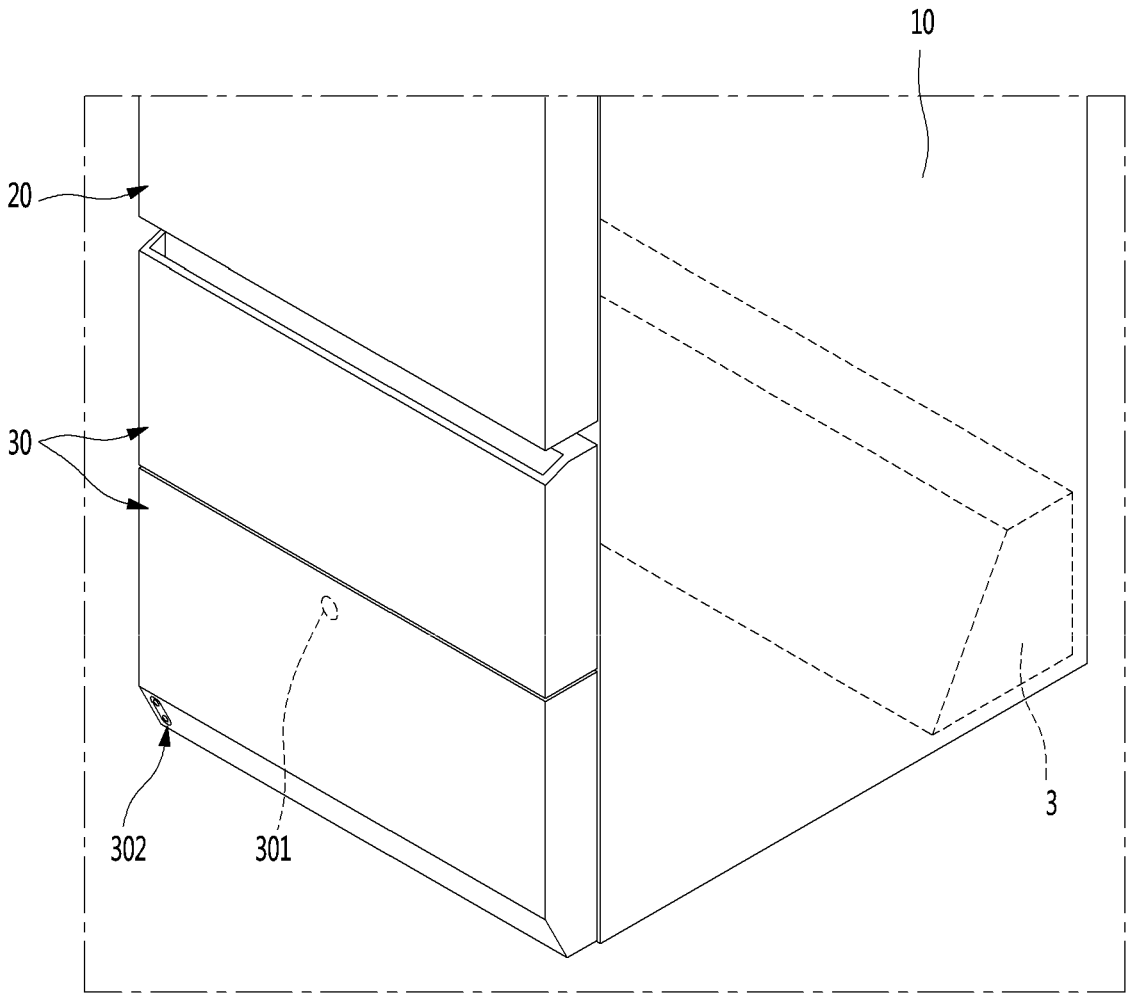
FIG. 8 is a perspective view illustrating a state in which the drawer door is closed.

FIG. 8 is a perspective view illustrating a state in which the drawer door is closed.

As illustrated in the drawing, in the state in which the food is stored, the refrigerator 1 may be maintained in a state in which all of the rotation door 20 and the drawer door 2 are closed. In this state, the user may withdraw the drawer door 2 to accommodate the food.

The drawer door 2 may be provided in plurality in a vertical direction and be withdrawn to be opened by the user's manipulation. Here, the user's manipulation may be performed by touching the manipulation part 301 disposed on the front surface of the rotation door 20 or the drawer door 2. Alternatively, an opening command may be inputted on the manipulation device 302 provided on the drawer door 2. Also, the manipulation part 301 and the manipulation device 302 may individually manipulate the insertion and withdrawal of the drawer door 2 and the elevation of the support member 35. Alternatively, the user may hold a handle of the drawer door 2 to open the drawer door 30.

Hereinafter, although the lowermost lower drawer door of the drawer doors 2, which are disposed in the vertical direction, is opened and elevated as an example, all of the upper and lower drawer doors 2 may be inserted and withdrawn and elevated in the same manner.

Figure 9:
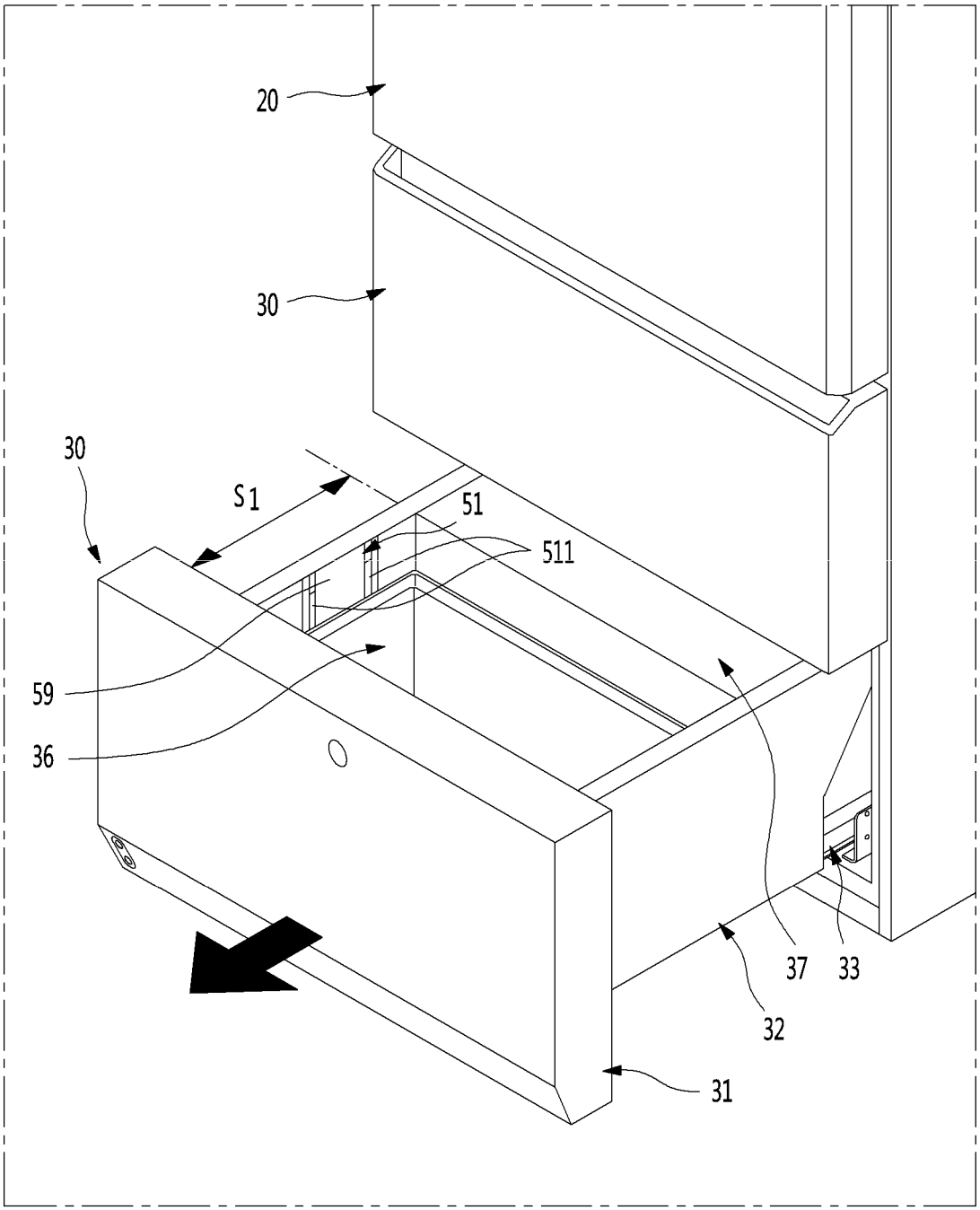
FIG. 9 is a perspective view illustrating a state in which the drawer door is completely opened.
Figure 10:
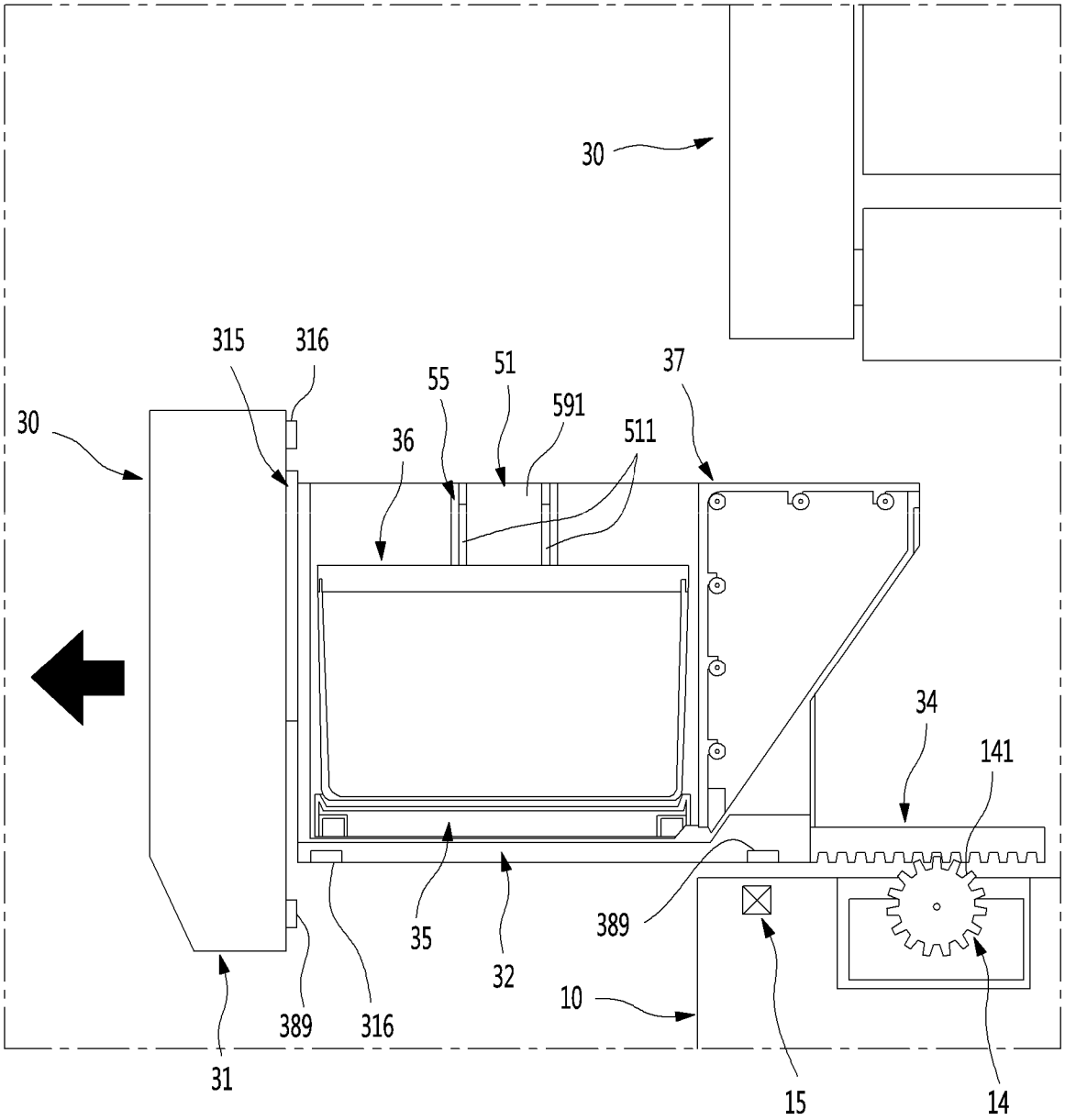
FIG. 10 is a cross-sectional view of the drawer door in the state of FIG. 9.

FIG. 9 is a perspective view illustrating a state in which the drawer door is completely opened. FIG. 10 is a cross-sectional view of the drawer door in the state of FIG. 9.

As illustrated in the drawings, the user may manipulate the draw-out operation on the lower drawer door 30 to withdraw the lower drawer door 30 forward. The lower drawer door 30 may be withdrawn while the draw-out rail 33 extends.

The lower drawer door 30 may be configured to be inserted and withdrawn by the driving of the draw-out motor 14, not by a method of directly pulling the lower drawer door 30 by the user. The draw-out rack 34 provided on the bottom surface of the lower drawer door 30 may be coupled to the pinion gear 141 rotating when the draw-out motor 14 provided in the cabinet 10 is driven. Thus, the lower drawer door 30 may be inserted and withdrawn according to the driving of the draw-out motor 14.

The draw-out distance of the lower drawer door 30 may correspond to a distance at which the front space S1 within the drawer part 32 is completely exposed to the outside. Thus, in this state, if the upper drawer door 60, in which the support member 35 is disposed at the upper side, is closed, the interference may not occur.

Here, the draw-out distance of the lower drawer door 30 may be determined by a draw-out detection device 15 disposed on the cabinet 10 and/or the lower drawer door 30. The draw-out detection device 15 may be provided as a detection sensor that detects a magnet 389 to detect a state in which the lower drawer door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the lower drawer door 30 is closed and a position of the magnet 389 when the lower drawer door 30 is completely withdrawn. Thus, the draw-out state of the lower drawer door 30 may be determined by the draw-out detection device 15.

Also, as necessary, a switch may be provided at each of positions at which the lower drawer door 30 is completely inserted and withdrawn to detect the draw-out state of the lower drawer door 30. In addition, the draw-out state of the lower drawer door 30 may be detected by counting the rotation number of draw-out motor 14 or measuring a distance between the rear surface of the door part 31 and the front end of the cabinet 10.

In the state in which the lower drawer door 30 is completely withdrawn, the elevation motor 411 may be driven to elevate the support member 35. The support member 35 may be driven in an even situation in which the lower drawer door 30 is sufficiently withdrawn to secure safe elevation of the food or container 36 seated on the support member 35.

That is, in the state in which the lower drawer door is withdrawn to completely expose the front space to the outside, the support member 35 may ascend to prevent the container 36 or the stored food seated on the support member 35 from interfering with the upper drawer door 60.

The ascending of the support member 35 may start in a state in which the lower drawer door 30 is completely withdrawn. Also, to secure the user's safety and prevent the food from being damaged, the ascending of the support member 35 may start after a set time elapses after the lower drawer door 30 is completely withdrawn.

After the lower drawer door 30 is completely withdrawn, the user may manipulate the manipulation part 301 to input the ascending of the support member 35. That is, the manipulation part 301 may be manipulated to withdraw the lower drawer door 30, and the manipulation part 301 may be manipulated again to elevate the support member 35. Also, the lower drawer door 30 may be manually inserted and withdrawn by a user's hand. After the lower drawer door 30 is withdrawn, the manipulation part 301 is manipulated to elevate the support member 35.

Figure 11:
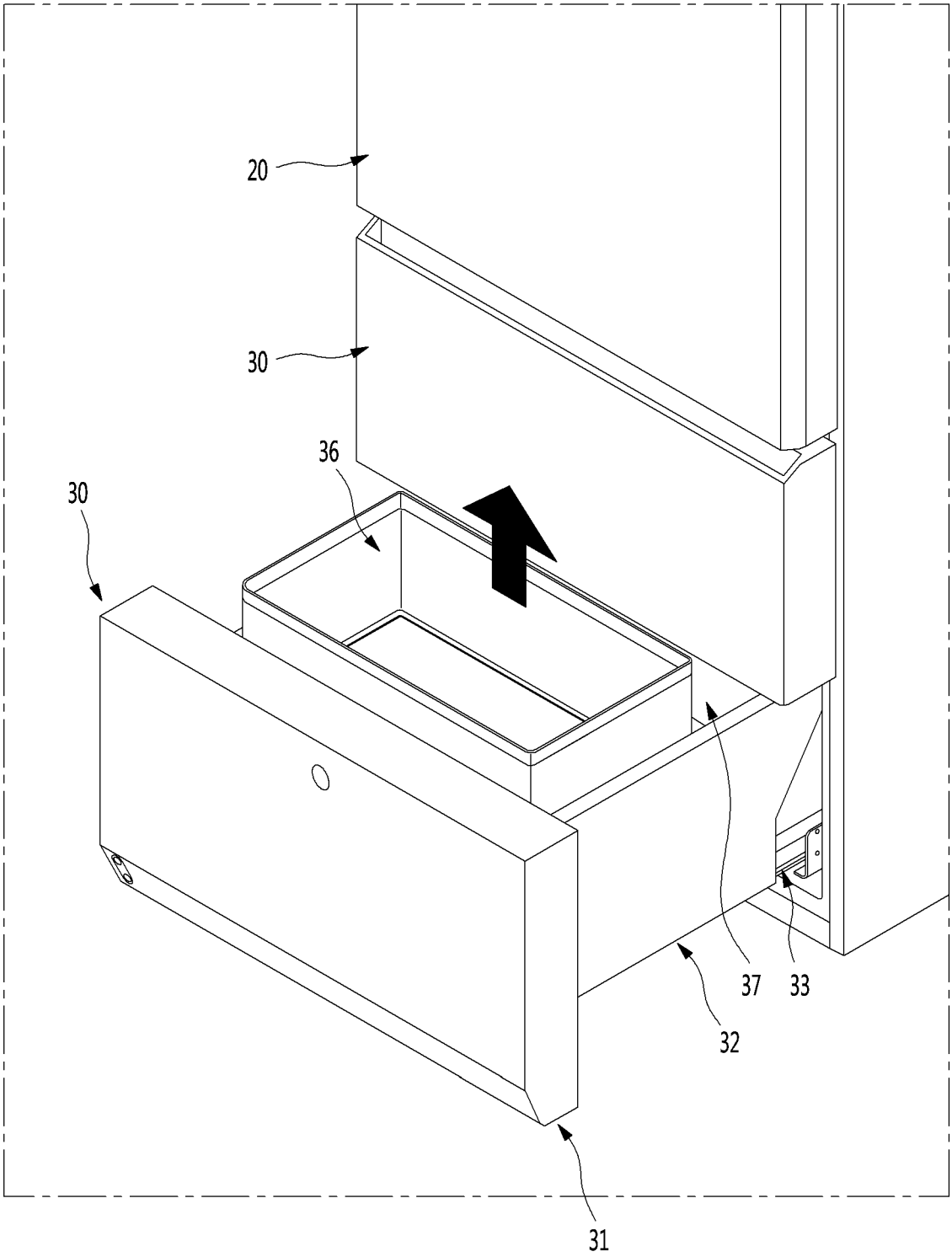
FIG. 11 is a perspective view illustrating a state in which the support member of the drawer door is completely elevated.
Figure 12:
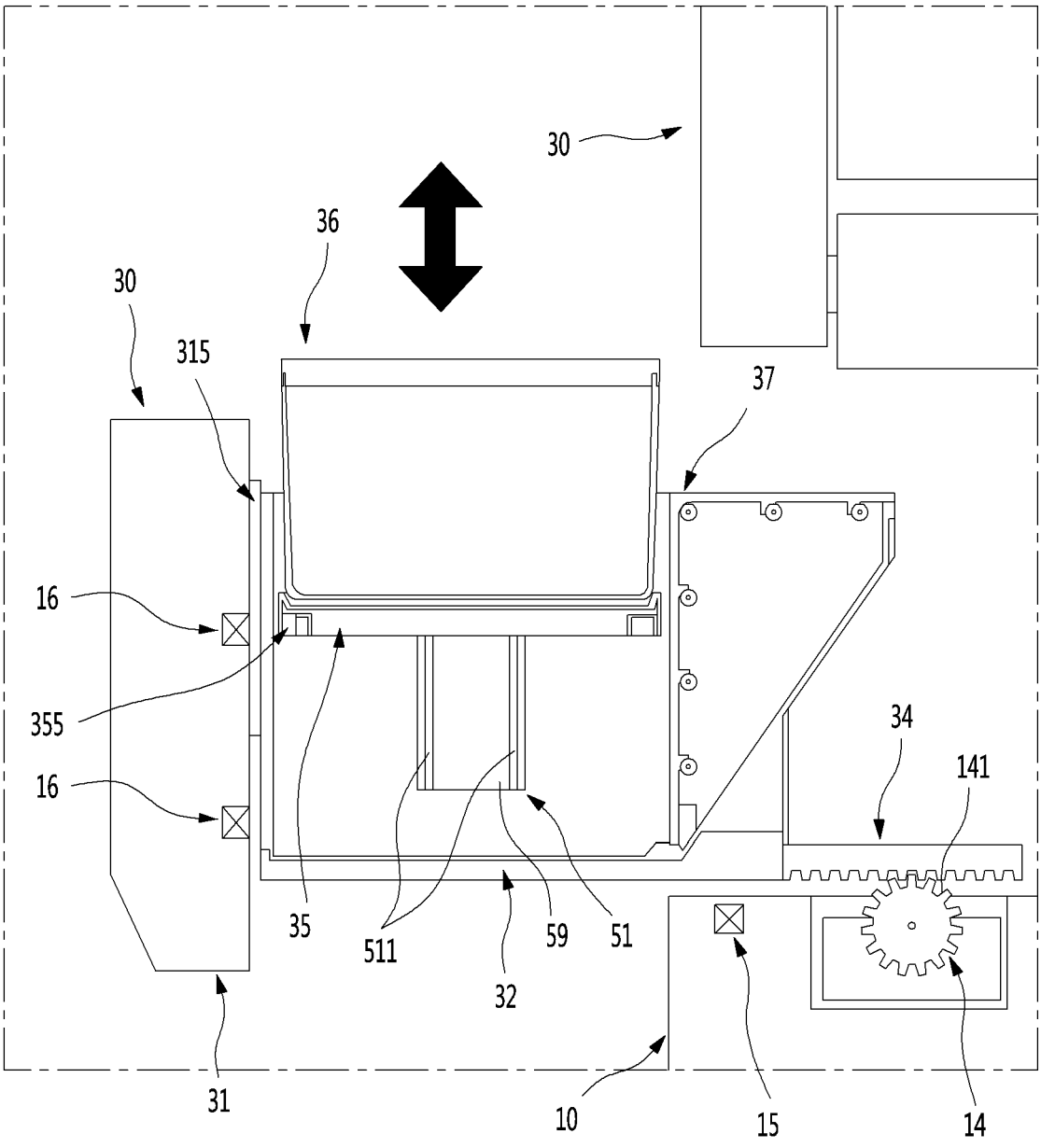
FIG. 12 is a cross-sectional view of the drawer door in the state of FIG. 11.

FIG. 11 is a perspective view illustrating a state in which the support member of the drawer door is completely elevated. FIG. 12 is a cross-sectional view of the drawer door in the state of FIG. 11.

As illustrated in the drawings, the elevation of the support member 35 may be performed in the state in the lower drawer door 30 is withdrawn. The support member 35 may be elevated by the operation of the elevation motor 411. In the state in which the door-side device 40 of the door part 31 and the drawer-side device 50 of the drawer part 32 are coupled to each other, the power may be transmitted to elevate the support member 35.

In more detail, when the elevation motor 411 operates, the door-side shafts 413 connected to the elevation motor 411 may rotate, and also the door-side first gear 414 connected to the door-side shaft 413 may rotate.

The door-side first gear 414 may allow the door connection member 416 exposed to both sides of the rear surface of the door part 31 to rotate in the state of being gear-engaged perpendicularly to the door-side second gear 415. That is, the door-side first gear 414 and the door-side second gear 415 may be gear-coupled so that the direction of the rotation axis is vertically converted.

The rotation force of the door-side device 41 may be transmitted to the drawer-side device 50 by door connection member 416 and the drawer connection member 522, which are coupled to each other. That is, the drawer connection member 522 coupled to the door connection member 416 may rotate, and the drawer-side gear 523 at the end of the drawer shaft 52 may rotate by the rotation of the drawer connection member 522.

The rotation force may be transmitted in the state in which the drawer-side gear 523 and the shaft gear 572 are vertically connected to each other, and the rotation force of the drawer-side shaft 52 may allow the elevation shaft 57 to rotate. That is, the elevation shaft 57 of the elevation device 50 disposed on both sides of the drawer part 32 may rotate at the same time, and the block holders 56 on both sides may vertically move at the same time along the elevation shaft 57.

The block holder 56 may vertically move together with the connecting bracket 54 in the state of being coupled to the connecting bracket 54, and the support member 35 coupled to the connecting bracket 54 may also move upward. Here, the connecting bracket 54 may be connected to a center of both side surfaces of each of the support member, and the elevation device may also be disposed at the center of the support member 35 to allow the support member 35 to be stably elevated without being tilted.

The support member 35 may continuously ascend by a sufficient height so that the user is accessible to the food or container seated on the support member 35. Thus, the user may easily lift the food or container.

The support member 35 may ascend until the block holder 56 is disposed at the upper end of the guide slit. When the ascending of the support member 35 is completed, the driving of the elevation motor 411 is stopped.

When an ascending completion signal is inputted, the driving of the elevation motor 411 may be stopped. For this, a height detection device 16 for detecting a position of the support member 35 may be provided. The height detection device 16 may be provided in the door part 31 at a height corresponding to the uppermost ascending position of the support member 35 and the lowermost descending position of the support member 35.

The height detection device 16 may be provided as a detection sensor that detects a magnet 355. The height detection device 16 may detect the magnet 355 disposed on the support member 35 to determine whether the ascending of the support member 35 is completed. Also, the height detection device 16 may be provided as a switch structure to turn on the switch when the support member 35 maximally ascends. Also, the height detection device 16 may be provided on the elevation rail 44 or the elevation shaft 57 to detect the maximally ascending position of the support member 35. Also, whether the support member 35 maximally ascends may be determined according to a variation in load applied to the elevation motor 411.

The driving of the elevation motor 411 is stopped in the state in which the support member 35 maximally ascends. In this state, although the support member 35 is disposed inside the drawer part 32, the food or container 36 seated on the support member 35 may be disposed at a position higher than the opened top surface of the drawer part 32. Thus, the user may easily access the food or container 36. Particularly, it is not necessary to allow the waist excessively for lifting the container 36, so that it is possible to perform safer and more convenient operation.

After the user's food storing operation is completed, the user may allow the support member 35 to descend by manipulating the manipulation part 301. The descending of the support member 35 may be performed by reverse rotation of the elevation motor 411 and may be gradually performed through the reverse procedure with respect to the above-described procedure.

Also, when the descending of the support member 35 is completed, i.e., in the state of FIG. 9 or 10, the completion of the descending of the support member 35 may be performed by the height detection device 16. The height detection device 16 may be further provided at a position that detects the magnet disposed on the support member 35 when the support member 35 is disposed at the lowermost descending position. Thus, when the completion of the descending of the support member 35 is detected, the driving of the elevation motor is stopped.

Also, after the driving of the elevation motor 411 is stopped, the lower drawer door 30 may be inserted. Here, the lower drawer door 30 may be closed by the user's manipulation or by the driving of the draw-out motor 14. When the drawer door 30 is completely closed, a state of FIG. 8 may become.

In the refrigerator 1 according to an embodiment, when the upper drawer door 60 is withdrawn while the lower drawer door is withdrawn and elevated, the container 36 or food of the lower drawer door 30, which moves upward, and the upper drawer door may collide with each other. To prevent this phenomenon, the upper drawer door 60 may be provided with a door restriction device 70 for preventing the lower drawer door 30 from being forcibly restricted when the lower drawer door 30 is withdrawn. Hereinafter, the door restriction device 70 will be described in more detail with reference to the drawing.

Figure 13:
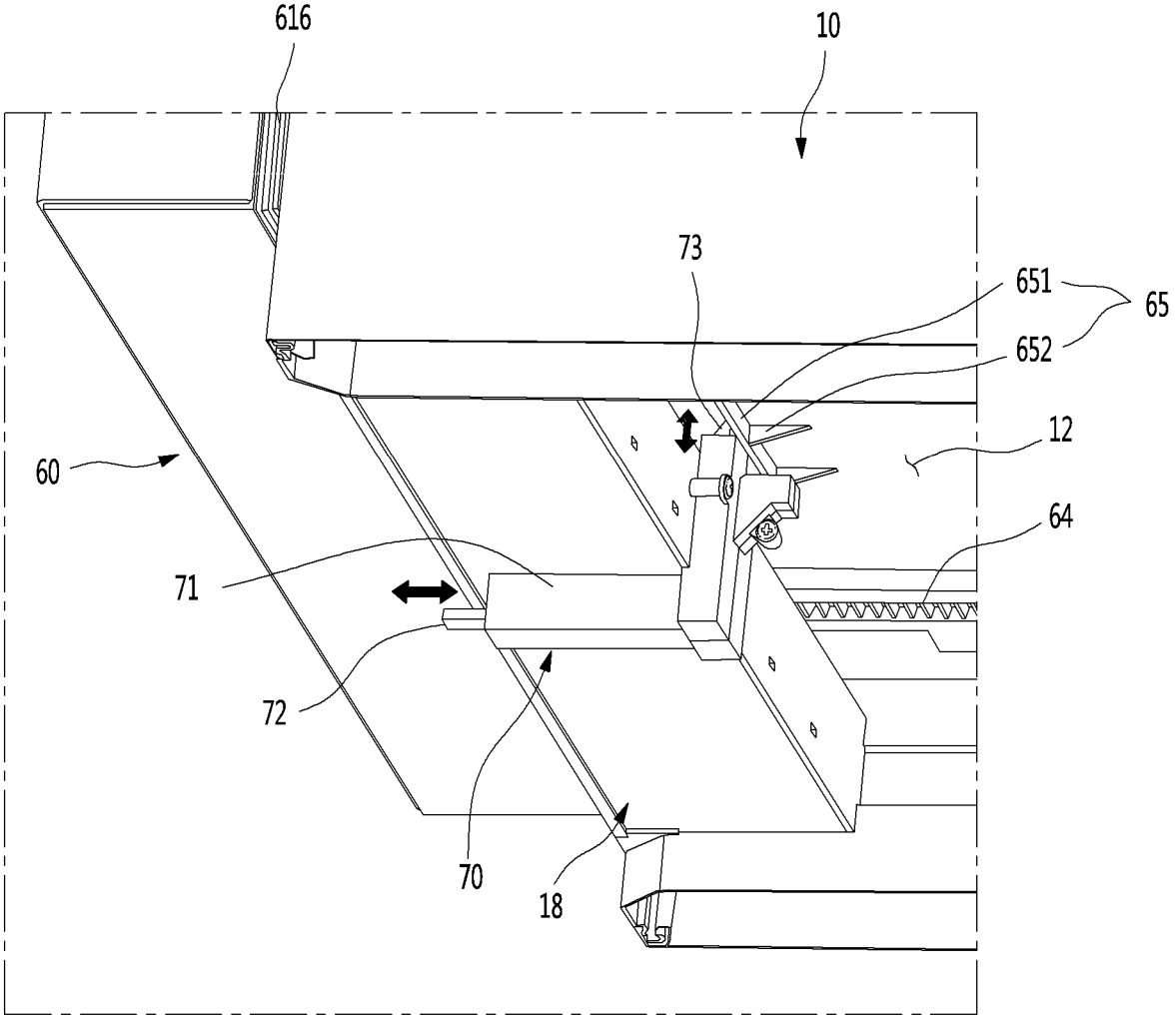
FIG. 13 is a partial cutaway perspective view illustrating a mounted state of a door restriction device according to an embodiment.

FIG. 13 is a partial cutaway perspective view illustrating a mounted state of the door restriction device according to an embodiment.

As illustrated in the drawing, the partition member 18 may be provided inside the cabinet 10 of the refrigerator 1 according to an embodiment.

The partition member 18 may be provided on the inner front end of the lower storage space 12 and extend from the left end to the right end to partition the front end of the lower storage 12. The upper drawer door 60 may be disposed above the partition member 18, and the lower drawer door 30 may be disposed to be insertable and withdrawable. The upper and lower portions of the lower storage space 12 may be completely partitioned by the partition member 18 and may be substantially divided into a space in which the upper drawer door 60 and the lower drawer door 30 are provided, and the upper drawer door 60 and the lower drawer door 30 may be partitioned by the partition member 18 only at the front end of the lower storage space 12.

Also, the front end of the partition member 18 may be configured to contact the upper drawer door 60 and the rear surface of the door part 31 of the lower drawer door 30. That is, the upper drawer door 60 and the gasket 316 on the rear surface of the door part 31 of the lower drawer door 30 may contact the front surface of the partition member 18 to seal the upper drawer door 60 and the lower drawer door 30.

The door restriction device 70 may be provided on one side of the partition member 18. The door restriction device 70 may be configured to selectively restrict the upper drawer door 60 depending on whether the lower drawer door 30 is opened or closed. For example, the door restriction device 70 may be configured to restrict an opening movement of the upper drawer door 60 based on the lower drawer door 30 being opened, and to allow the opening movement of the upper drawer door 60 based on the lower door 30 being closed.

The door restriction device 70 may include a push member 72, which is mounted on edges of the rear and bottom surfaces of the partition member 18 and pressed by the lower drawer door 30 when the lower drawer door 30 is closed, and a slider 73 vertically moving by the push member 72. The slider 73 may protrude upward when the lower drawer door 30 is closed and may hook the door restriction part 65 of the upper drawer door 60.

The door restriction part 65 may be provided on the bottom surface of the upper drawer door 60 and may be disposed at a position corresponding to the slider 73 in the state in which the upper drawer door 60 is closed.

The door restriction part 65 may include a restriction rib 651 extending downward and a reinforcement rib 652 extending in the cross direction from the rear side of the restriction rib 651. The upper end of the slider 73 may contact the front surface of the restriction rib 651. When the slider 73 and the door restriction part 65 are restricted, the upper drawer door 60 may be restricted, and thus, the forward withdrawal of the upper drawer door 60 may be impossible.

Figure 14:
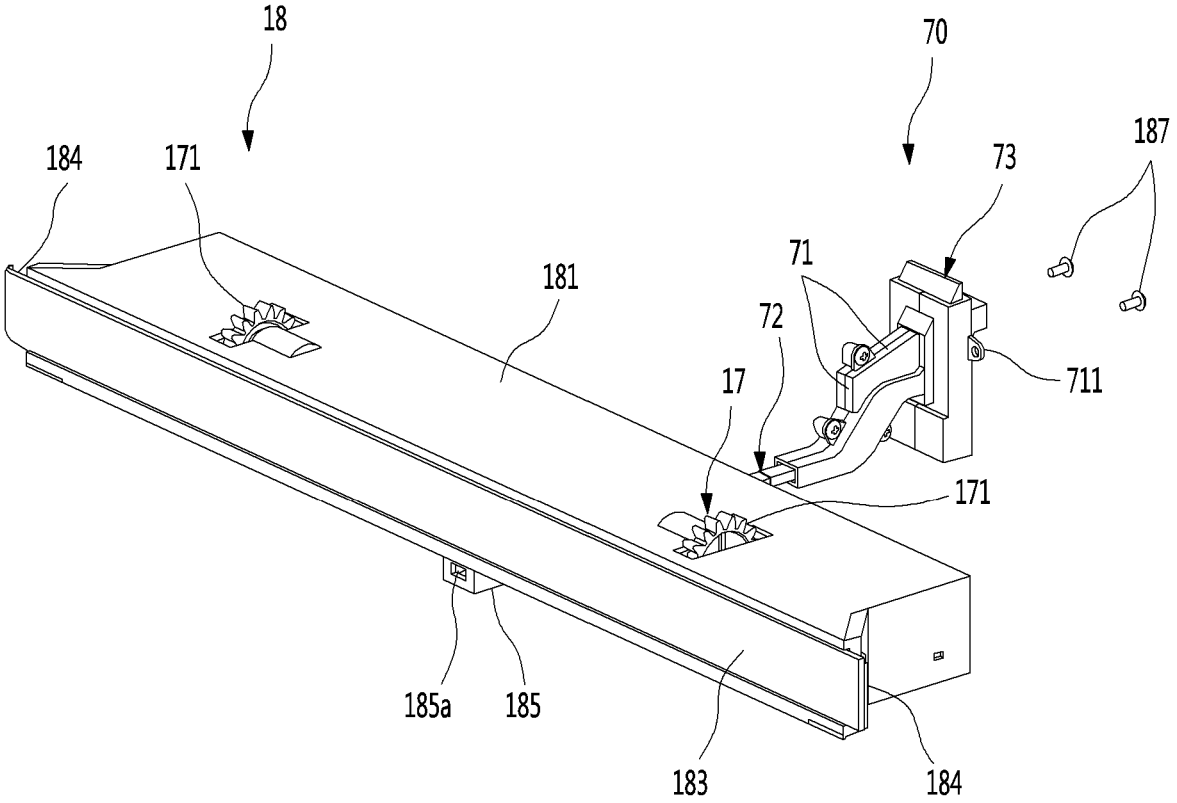
FIG. 14 is an exploded front perspective view illustrating a mounting structure of the door restriction device.
Figure 15:
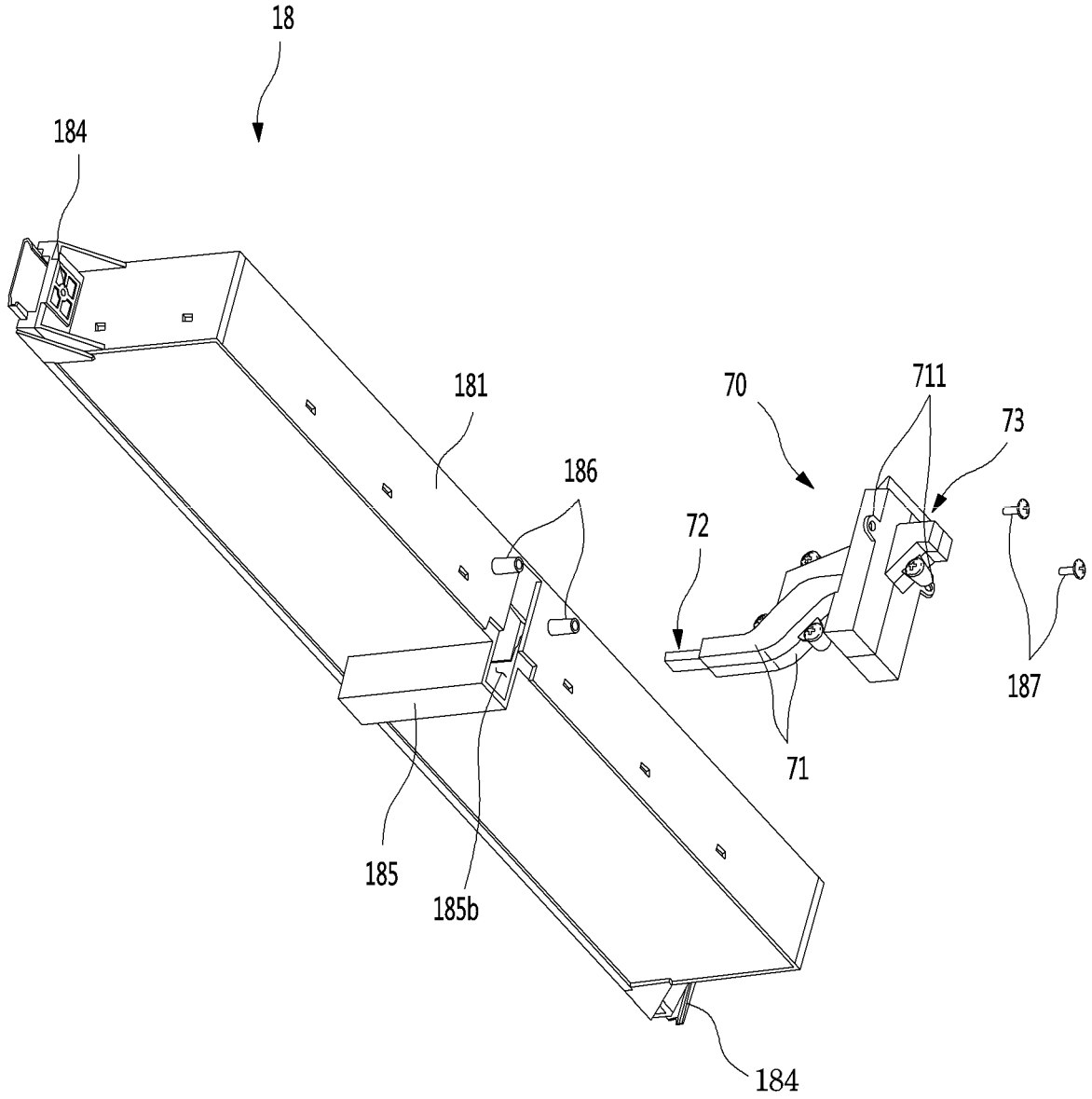
FIG. 15 is an exploded rear perspective view illustrating the mounting structure of the door restriction device.

FIG. 14 is an exploded front perspective view illustrating a mounting structure of the door restriction device. FIG. 15 is an exploded rear perspective view illustrating the mounting structure of the door restriction device.

Referring to the drawings, the partition member 18 may be defined in outer shape by a partition member case 181 made of a plastic injection material and may be filled with an insulation material 182. Also, a front plate 183 having a metal plate shape may be disposed on a front surface of the partition member 18. Thus, when the upper drawer door 60 and the lower drawer door 30 are closed, the gasket and the front plate 183 may be closely attached to each other to more seal the upper drawer door 60 and the lower drawer door 30.

The upper draw-out motor 17 and the upper pinion 171 may be provided in the partition member 18. The upper draw-out motor 17 and the upper pinion 171 may be provided on both sides of the partition member 18, and a pair of upper pinions 171 may be exposed through the upper surface of the partition member 18 and may be configured to be gear-coupled to the upper draw-out rack 64 on the bottom surface of the upper drawer door 60.

The upper draw-out motor 17 may be provided on the inner side of the partition member 18 so that the upper pinions 171 on both sides are connected by a shaft and rotate by one upper draw-out motor 17.

The upper pinion 171 may be driven by the user's input manipulation so that the upper pinion 171 rotates forward. Thus, the upper pinion 171 moves along the upper draw-out rack 64, and the upper drawer door 60 may be automatically inserted and withdrawn. Of course, the upper drawer door 60 may not be inserted and withdrawn when the upper drawer door 60 is restricted by the door restriction device 70.

A partition member fixing part 184 for fixing the partition member 18 to the cabinet 10 may be disposed on each of both sides of the partition member 18. Also, a restriction device mounting part 185 to which the door restriction device 70 is mounted may be disposed at the center of the partition member 18.

The restriction device mounting part 185 may be disposed on the bottom surface of the partition member 18. Also, the partition member case 181 may protrude downward to provide a space in which the door restriction device 70 is accommodated.

Also, the restriction device mounting part 185 may include a rear opening **185*b* for allowing the door restriction device 70 to be inserted from the rear side and a front opening for allowing the front end of the push member 72 of the door restriction device 70 to protrude. Thus, the push member 72 may protrude through the front opening 185*a* in the state in which the door restriction device 70 is mounted on the restriction device mounting part 185 through the rear opening 185***b*.

Also, a mounting boss 186 protruding backward may be disposed on each of both right and left sides of the rear opening 185*b*. The mounting boss 186 may be disposed at a position corresponding to the case mounting part 711 on each of both sides of the door restriction device 70, and a screw 187 passing through the case mounting part 711 may be coupled to the door restriction device 70 to allow the door restriction device 70 to be maintained in the state in which the door restriction device 70 is fixedly mounted on the partition member 18.

Hereinafter, the door restriction device 70 will be described in more detail with reference to the drawings.

Figure 16:
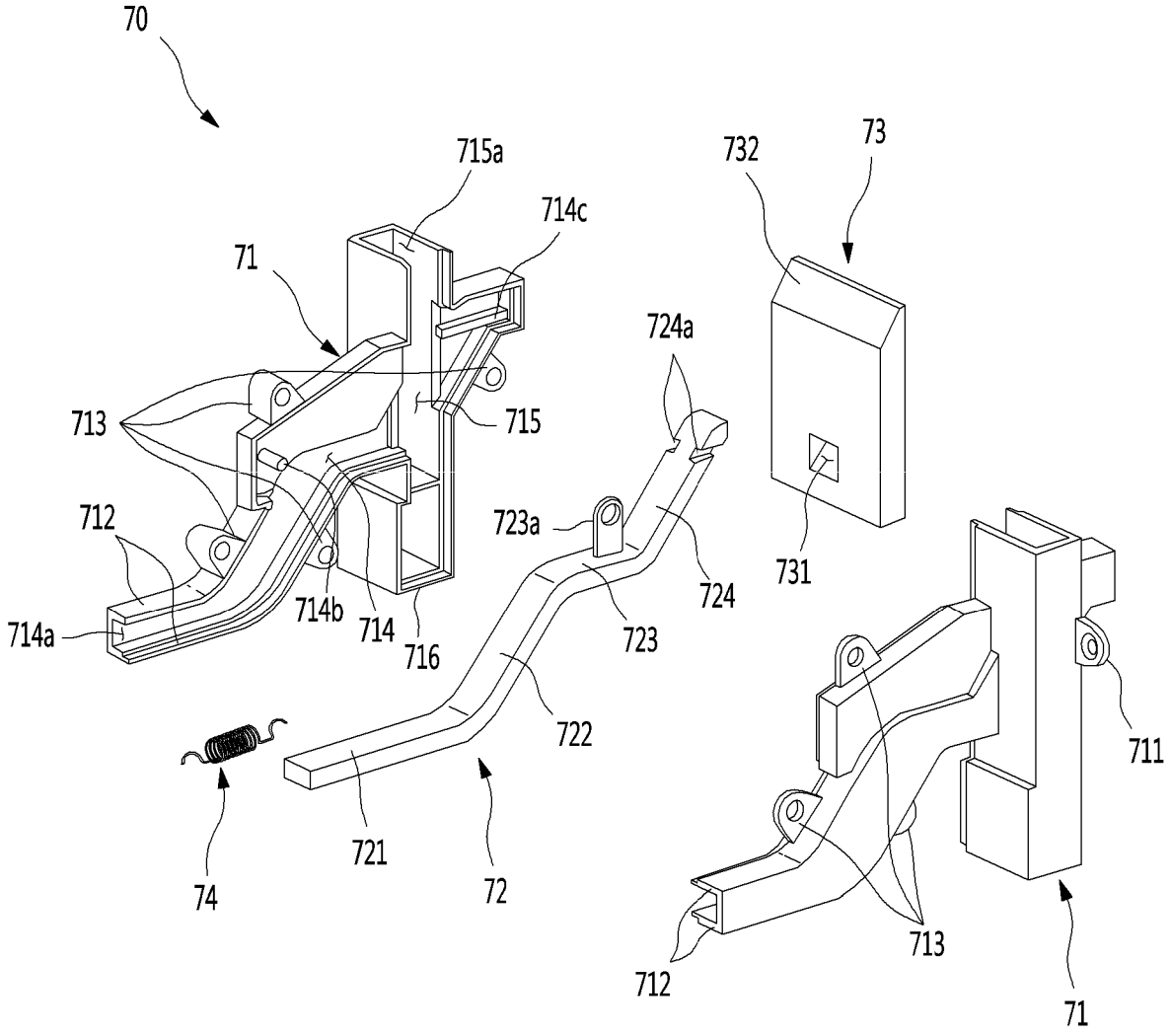
FIG. 16 is an exploded perspective view illustrating the coupling structure of the door restriction device.
Figure 17:
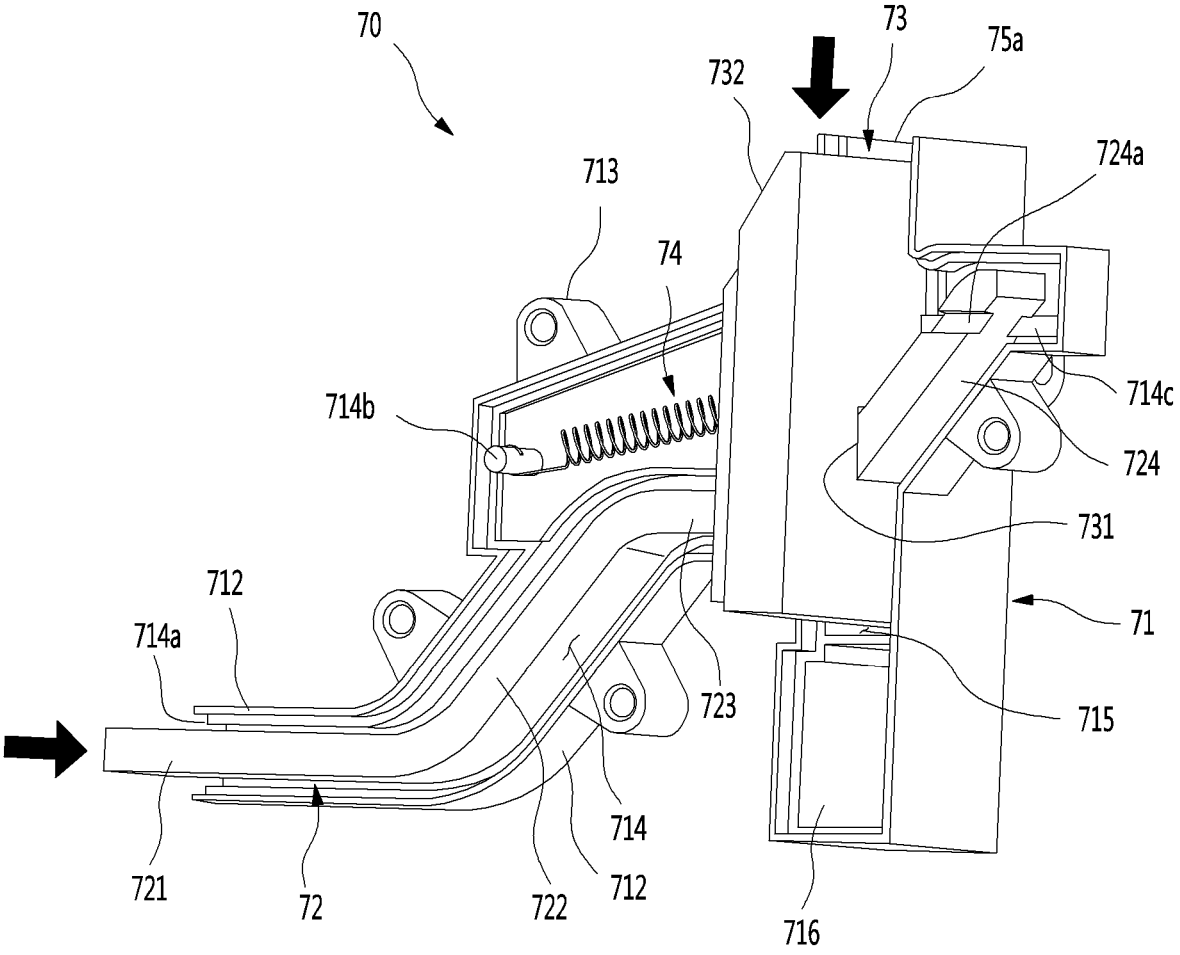
FIG. 17 is a cutaway perspective view illustrating a state in which the door restriction device is restricted.
Figure 18:
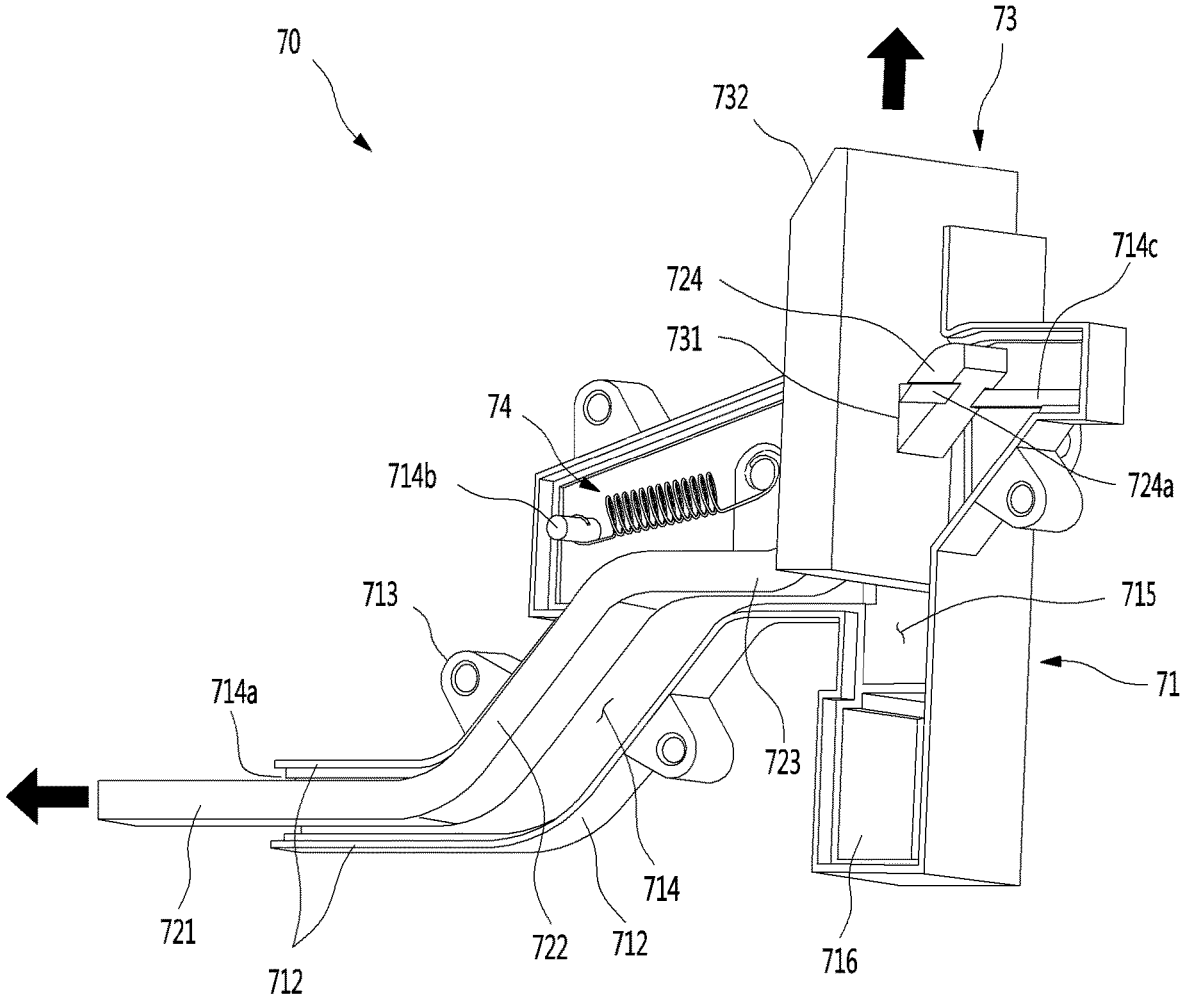
FIG. 18 is a cutaway perspective view illustrating a state in which the door restriction device is not restricted.

FIG. 16 is an exploded perspective view illustrating the coupling structure of the door restriction device. Also, FIG. 17 is a cutaway perspective view illustrating a state in which the door restriction device is restricted. Also, FIG. 18 is a cutaway perspective view illustrating a state in which the door restriction device is not restricted.

As illustrated in the drawings, the door restriction device 70 may include the pair of restriction cases 71, the push member 72 within the restriction device case 71, the slider 73, and the elastic member 74.

The restriction device case 71 may be provided in a pair on left and right sides, which are coupled to each other to define a space therein. The restriction device case 71 may have a space in which the push member 72 moves in the forward and backward direction and a space in which the slider 73 moves in the vertical direction. Thus, the push member 72 and the slider 73 may be accommodated in a movable state.

The restriction device case 71 may have the same structure on both left and right sides, and an edge 712 may be disposed along the outer circumference thereof. Thus, when the pair of restriction device cases 71 are coupled to each other, a space in which the push member 72 and the slider 73 are disposed may be defined.

Also, a plurality of case coupling parts 713 may be disposed on the edge 712. The case coupling parts 713 may be disposed at positions corresponding to the respective restriction device cases 71 on both sides, and the restriction device cases 71 on both sides may be coupled to each other through screw coupling. Also, a push member opening 714*a* through which an end portion of the push member 72 is inserted and withdrawn may be disposed at the front end of the door restriction device 70 in a state where the restriction device cases 71 are coupled to each other, and a slider opening 715*a* through which the slider 73 is accessible may be defined in an upper end of the slider 731.

Also, the space defined in the restriction device case 71 may include a push member accommodation part 714 and a slider accommodation part 715.

The push member accommodation part 714 may have a shape corresponding to that of the push member 72 and extend forward and backward so that the push member 72 is accommodated therein. Also, the inside of the push member accommodation part 714 may have a predetermined width by a movement distance of the push member 72 so as not to interfere with the push member 72 when the push member 72 moves forward and backward.

Also, the push member accommodation part 714 may accommodate the elastic member 74 that provides elastic force when the push member 72 moves to return to its original position. The elastic member 74 may have a coil shape, and both ends of the elastic member 74 may be connected to the restriction device case and the push member 72, respectively. Thus, the elastic member 74 may provide elastic force when the push member 72 moves.

Also, a first elastic member fixing part 714*b* may be provided inside the push member accommodation part 714. The first elastic member fixing part 714*b* may protrude from the inside of the push member accommodation part 714 so as to be fixed to one end of the elastic member 74.

Also, a movement guide 714*c* for guiding the push member 72 forward and backward may protrude from a side of the push member accommodation part 714. The movement guide 714*c* may be accommodated in a guide groove 724*a* defined in each of both sides of the push member 72 to guide the push member 72 forward and backward. The movement guide 714*c* may be disposed in the front and rear direction in which the push member 72 moves and may be provided to correspond to at least the movement distance of the push member 72 in the front and rear direction.

Also, a front end of the push member accommodation part 714 may be opened to define the push member opening 714*a*. Also, the push member accommodation part 714 may cross the slider accommodation part 715.

The slider accommodation part 715 may be disposed at a position corresponding to an inclined part of the push member 72 in the push member accommodation part 714. The slider accommodation part 715 may vertically extend in a rear part of the push member accommodation part 714 and may be disposed to cross the push member accommodation part 714.

The slider accommodation part 715 may be provided to completely accommodate the slider 73. Also, the lower end of the slider accommodation part 715 may be configured to support the lower surface of the slider 73 in a state in which the slider 73 completely move downward. The upper end of the slider accommodation part 715 may provide the upper end of the restriction device case 71, and the slider opening 715*a* may be defined in the upper end of the slider accommodation part 715.

Also, the slider accommodation part 715 may extend upward so that the upper end of the slider 73 is not exposed through the upper end of the slider accommodation part 715, i.e., the slider opening 715*a*. Also, when the slider 73 moves upward by the movement of the push member 72, the upper end of the slider 73 may protrude outward over the slider opening 715*a*.

A restriction device insertion part 716 may be further provided below the slider accommodation part 715 and extend further downward in the extending direction of the slider accommodation part 715. Also, the restriction device insertion part 716 may be inserted into the restriction device mounting part 185 to maintain the fixed state of the door restriction device 70. Also, each of the restriction device insertion part 716 and the slider accommodation part 715 may have a width greater than that of the push member accommodation part 714 to completely cover a rear opening 185*b* of the restriction device mounting part 185.

The push member 72 may have a size and shape that is enough to be accommodated inside the push member accommodation part 714 and contact the lower drawer door 30 through the push member opening 714*a*. Also, the push member may slidably move forward and backward inside the push member accommodation part 714 according to the contact state with the lower drawer door 30.

The push member 72 may include horizontal parts 721 and 723 moving forward and backward and contacting the lower drawer door 30 and inclined parts 722 and 724 inclinedly extending with respect to the horizontal parts 721 and 723 to allow the slider 73 to move vertically. The horizontal parts 721 and 723 and the inclined parts 722 and 724 may be provided in plurality as necessary and may have number suitable for contacting the lower drawer door 30 and for elevating the slider 73.

In this embodiment, the horizontal part may include a first horizontal part 721 and a second horizontal part 723. The inclined part may include a first inclined part 722 and a second inclined part 724.

In more detail, the first horizontal part 721 provides a front end of the push member 72, and the front end may be configured to be inserted and withdrawn through the push member opening 714*a*. Also, the first horizontal part 721 may be disposed to perpendicularly cross the slider 73.

The first inclined part 722 may extends inclinedly from the rear end of the first horizontal part 721 and extend upward and backward to have a predetermined inclination. The first inclined part 722 may be disposed between the first horizontal part 721 and the second horizontal part 723, and the arrangement position of the slider 73 may be determined by a length of the first inclined part 722.

A second horizontal part 723 may be disposed on a rear end of the first inclined part 722. The second horizontal part 723 may extend backward and may extend by a predetermined length so as to be disposed at a position at which the second inclined part 724 crosses the slider accommodation part 715. Also, the second horizontal part 723 may be parallel to the first horizontal part 721.

Also, a second elastic member fixing part 723*a* to which the end of the elastic member 74 is fixed may be disposed on the second horizontal part 723. The second elastic member fixing part 723*a* may extend upward from one side of the second horizontal part 723 to fix the end portion of the elastic member 74. Thus, the elastic member 74 may be fixed by the first elastic member fixing part 714*b* and the second elastic member fixing part 723*a*, and the push member 72 may move backward. The pushing member 72 may move forward as shown in FIG. 17 by the elastic force of the elastic member 74 to return to its initial state when the external force is removed.

The second inclined part 724 may extend backward and upward from the rear end of the second horizontal part 723. Also, the second inclined part 724 may extend through the slider 73 to the rear end of the push member accommodation part 714. Thus, the slider 73 may move in the vertical direction according to the movement of the push member 72 in the longitudinal direction.

A guide groove may be further provided in each of both side surfaces of the second inclined part 724 corresponding to the movement guide 714*c*. The movement guide 714*c* may be inserted into the guide groove 724*a* when the push member 72 is mounted. Thus, the push member 72 may horizontally move by the movement guide 714*c* when moving forward and backward.

The first inclined part 722 and the second inclined part 724 may move together when the push member 72 moves forward and backward. Thus, a portion of each of the first inclined part 722 and the second inclined part 724 of the restriction device case 71 may have a width greater than a thickness of each of the first inclined part 722 and the second inclined part 724 so as not to interfere the first inclined part 722 and the second inclined part 724 even when the first inclined part 722 and the second inclined part 724 move.

The slider 73 may be accommodated inside the slider accommodation part 715 and may be penetrated by the push member 72 in the mounted state. The slider 73 may have a horizontal width larger than that of the push member 72, and a through-hole 731 may be defined in a center of a lower portion thereof.

Also, the slider 73 may have a shape corresponding to the width and thickness of the slider accommodation part 715 and may be movable only in the vertical direction when the slider is accommodated inside the slider accommodation part 715.

The through-hole 731 may be defined to be penetrated by the second inclined part 724 of the push member 72. The inner top surface and bottom surface of the through-hole 731 may be defined to have an inclination corresponding to that of the second inclined part 724.

Thus, when the push member 72 moves forward and backward while the slider 73 is penetrated by the second inclined part 724, the slider 73 accommodated in the slider accommodation part 715 may vertically move along the inclined surface of the second inclined part 724.

The upper end of the slider 73 may protrude upward from the slider opening 715*a* and may be disposed at the highest position in a state where the push member 72 completely moves backward.

Also, when the slider 73 is disposed at the highest position, the end of the slider 73 may be restricted and coupled to the door restriction part 65. Also, an inclined surface 732 may be provided on the upper end of the slider 73. The upper end of the slider 73 may have a height that gradually increase from the front side to the rear side by the inclined surface 732. Thus, when the upper end of the slider 73 protrudes above the slider opening 715*a* in a state in which the upper drawer door 60 is opened, the door restriction part 65 may contact the inclined surface 732 to allow the slider 73 to move downward, thereby preventing the drawer restriction device 70 from being damaged.

Hereinafter, the restricted state and the release state of the restriction of the upper drawer door 60 due to the insertion and the withdrawal of the lower drawer door 30 of the refrigerator 1 having the above-described structure according to an embodiment will be described.

Figure 19:
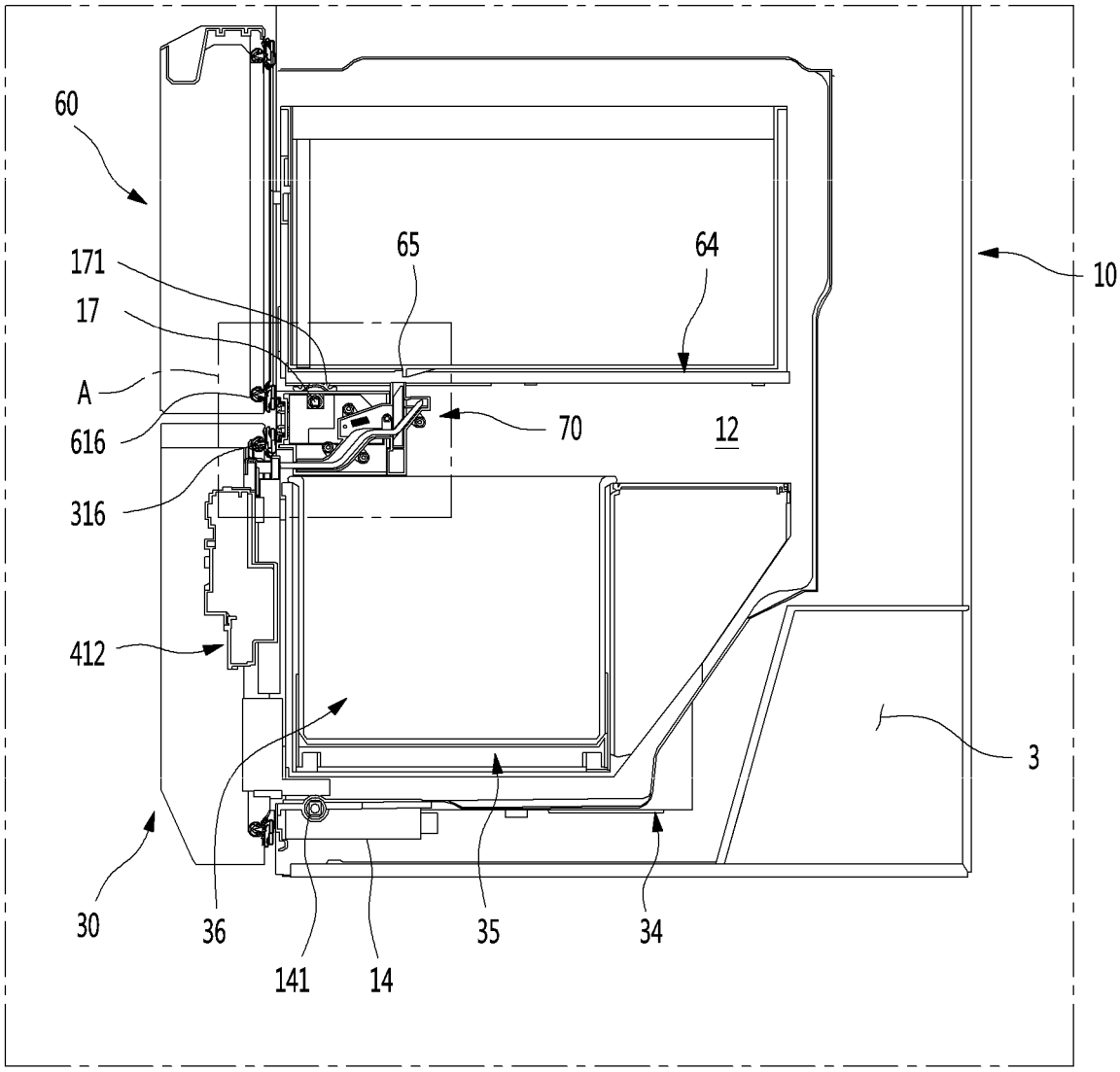
FIG. 19 is a view illustrating a state in which the drawer door is closed.
Figure 20:
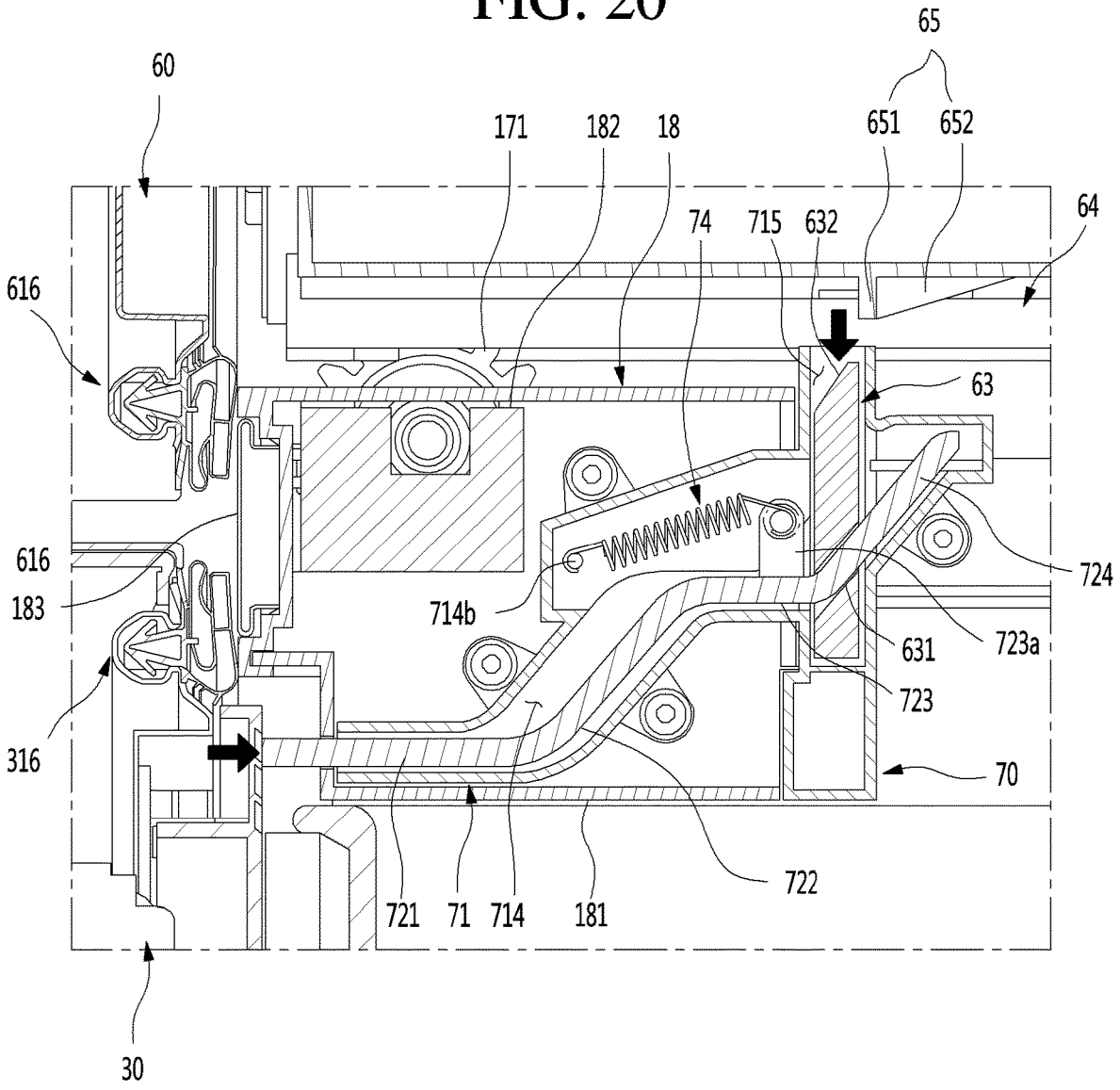
FIG. 20 is an enlarged view illustrating a portion A of FIG. 19.
Figure 21:
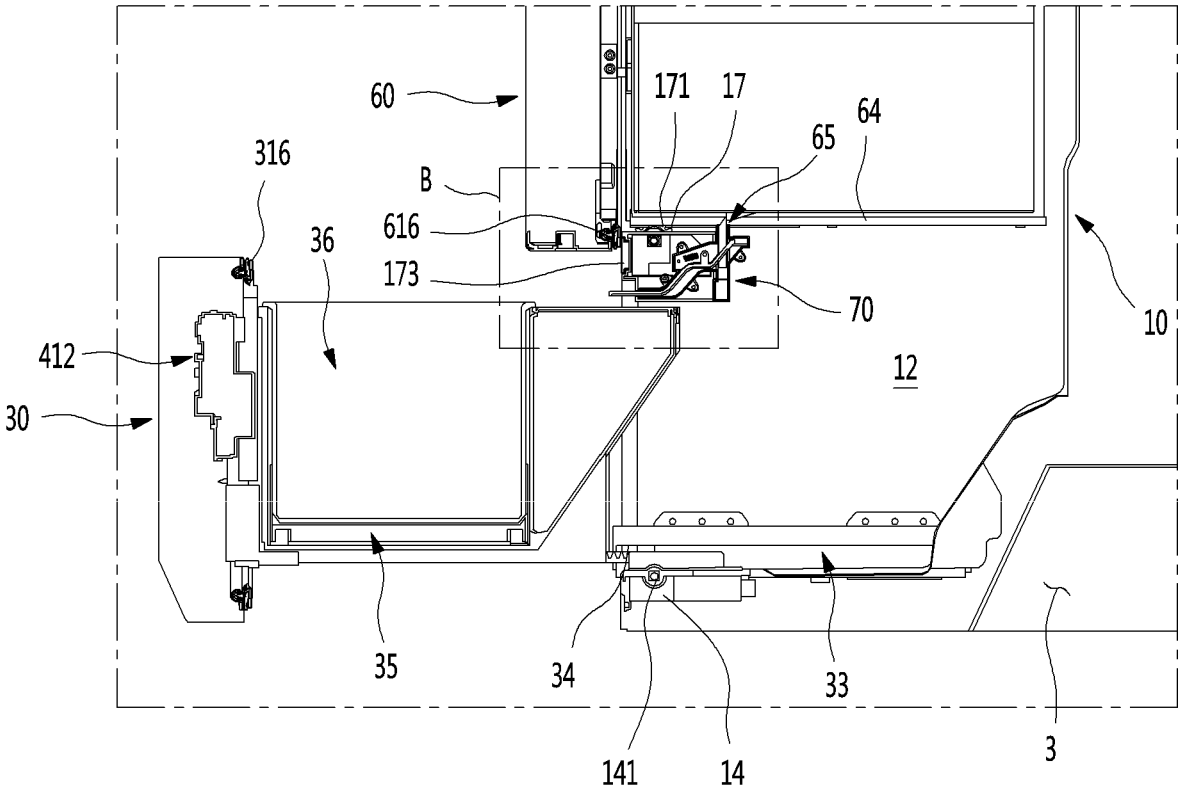
FIG. 21 is a view illustrating a state in which the drawer door is withdrawn to be elevated.

FIG. 19 is a view illustrating a state in which the drawer door is closed. Also, FIG. 20 is an enlarged view illustrating a portion A of FIG. 19.

As illustrated in the drawings, the upper drawer door 60 and the lower drawer door 30 may cover the lower storage space 12 in the cabinet 10 when both the upper drawer door 60 and the lower drawer door 30 are closed.

In this state, the gasket 316 may be closely attached to the front surface of the partition member 18 to maintain the sealed state. In addition, the rear surface of the door part 31 of the lower drawer door 30 may be maintained in the contact with the door restriction device 70 and may be in a state in which the rear surface presses the pushing member 72.

That is, the push member 72 may be disposed at the rearmost position inside the restriction device case 71, and the elastic member 74 is tensioned by a maximum length. Also, the slider 73 may be disposed below the second inclined part 724 and may be disposed at the lowest position inside the slider accommodation part 715.

Thus, the upper end of the slider 73 may not contact the door restriction part 65 disposed on the bottom surface of the upper drawer door 60 and may be disposed at a lower position than the lower end of the door restriction part 65 so as not to interfere with the upper drawer door 60 at all when the upper drawer door 60 is inserted and withdrawn.

In this state, the upper drawer door 60 may be withdrawn forward by user's manipulation and then may be inserted again after being withdrawn. Of course, the upper draw-out motor 17 may be driven by the user's manipulation, and the upper pinion 171 may move along the upper draw-out rack 64 so that the upper drawer door 60 is automatically inserted and withdrawn.

The draw-out motor 14 of the lower drawer door 30 may also be driven by the user, and the pinion 141 may move along the draw-out rack 34 so that the lower drawer door 30 is automatically inserted and withdrawn. Also, the lower drawer door 30 may operate to elevate the support member 35 in the withdrawn state.

That is, the upper drawer door 60 and the lower drawer door 30 may be freely inserted and withdrawn by the user's manipulation.

Figure 22:
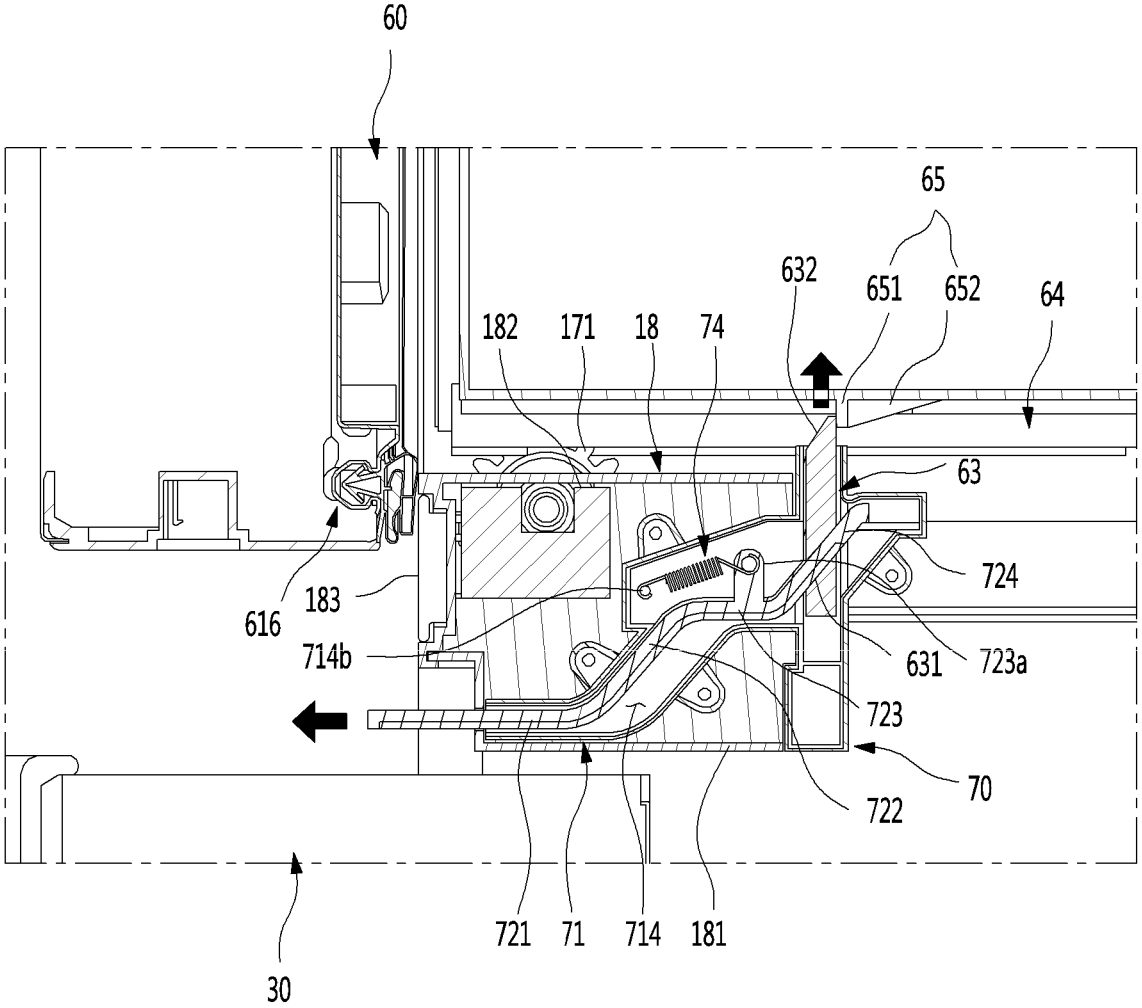
FIG. 22 is an enlarged view illustrating a portion B of FIG. 21.
Figure 23:
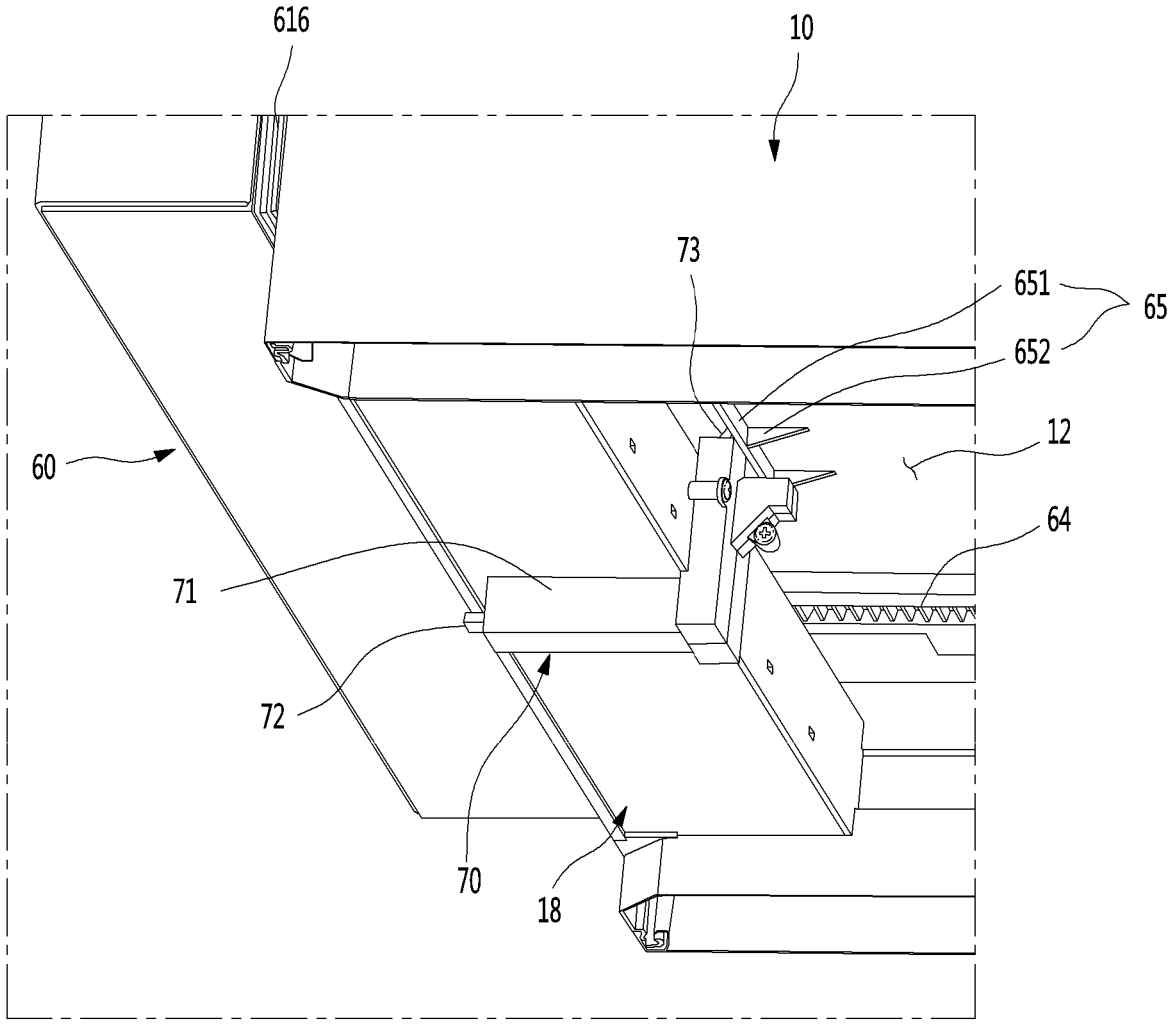
FIG. 23 is a cutaway perspective view illustrating a state of the door restriction device in the state of FIG. 21.

FIG. 22 is a view illustrating a state in which the drawer door is closed. Also, FIG. 23 is an enlarged view illustrating a portion B of FIG. 22.

As illustrated in the drawings, the lower drawer door 30 may be withdrawn by the user's manipulation. The draw-out motor 14 may be driven according to the user's input manipulation, and the lower drawer door 30 may be withdrawn forward.

Also, when the lower drawer door 30 is withdrawn by a set distance, the elevation motor 411 may operate, and power may be transmitted through the door-side device 41 and the drawer-side device 50. Thus, the support member 35 may be elevated.

The lower drawer door 30 may move forward at the same time when the drawer door 30 is withdrawn. Thus, the door part 31 of the lower drawer door 30 may be separated from the push member 72. When the force of the lower drawer door 30 pressing the push member 72 may be removed, the push member 72 may move forward due to the elastic force of the elastic member 74. Also, the forward movement of the push member 72 may be guided by the guide groove 724*a* and the movement guide 714*c* of the push member 72 when the push member 72 moves forward.

As the push member 72 moves forward, the slider 73 passing through the second inclined part 724 may move upward. The slider 73 may be accommodated in the slider accommodation part 715 and be movable only in the vertical direction. When the second inclined part 724 moves forward, the inclined inner top and bottom surfaces of the through-hole 731 may move along the inclined surface of the second inclined part 724.

Thus, the slider 73 may move upward, and the upper end of the slider 73 may protrude upward through the slider opening 715*a*. The protruding upper end of the slider 73 may be hooked with the front surface of the door restriction part 65 at the front side of the door restriction part 65 as shown in FIG. 23. Thus, the forward movement of the upper drawer door 60 may be restricted.

The push member 72 may move forward by the elastic member 74 at the same time when the lower drawer door 30 is withdrawn, and the slider 73 may move upward simultaneously with the movement of the push member 72 so as to be hooked the door restriction part 65 and be restricted.

That is, since the upper drawer door 60 is restricted at the same time when the lower drawer door 30 is withdrawn, the upper drawer door 60 may not be withdrawn forward.

Thus, since the lower drawer door 30 ascends after being withdrawn forward, in the state in which the lower drawer door 30 ascends, the lower drawer door 30 may be prevented in principle from colliding or interfering with the upper drawer door 60 in the state of being withdrawn.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 24:
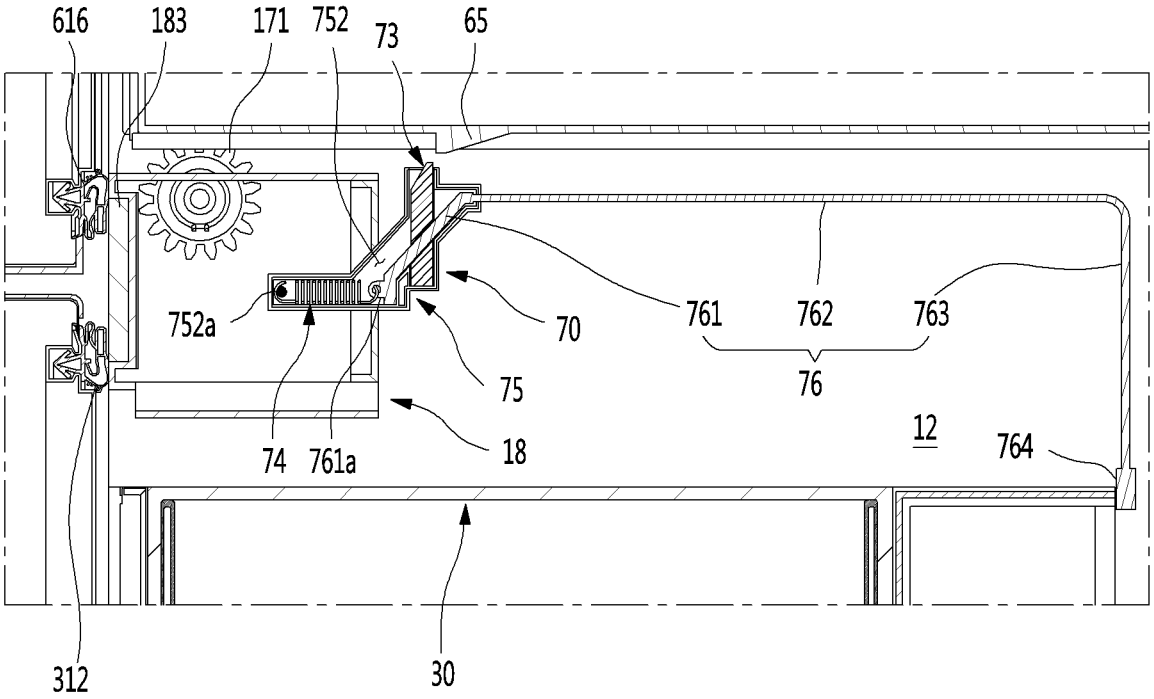
FIG. 24 is a view illustrating a state in which a drawer door of a refrigerator is closed according to another embodiment.
Figure 25:
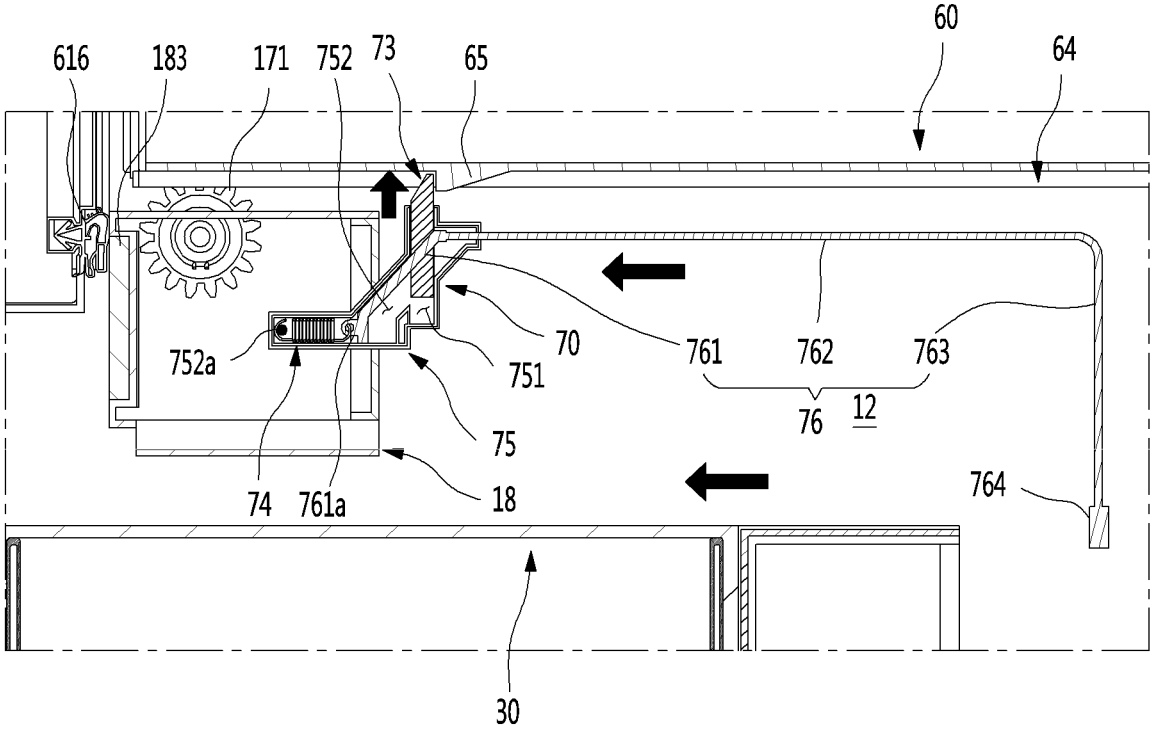
FIG. 25 is a view illustrating a state in which the drawer door of the refrigerator is opened.

FIG. 24 is a view illustrating a state in which a drawer door of a refrigerator is closed according to another embodiment. Also, FIG. 25 is a perspective view of the refrigerator with a door opened.

As illustrated in the drawings, a refrigerator 1 according to another embodiment may include a cabinet 10 in which a storage space 12 is defined. Also, an upper drawer door 60 and a lower drawer door 30 may be vertically disposed in the storage space 12 of the cabinet 10, the upper drawer door 60 and the lower drawer door 30 may be provided at a front end of the storage space 12, and a partition member 18 contacting the upper drawer door 60 and the lower drawer door 30 in a closed state may be provided.

The partition member 18 may be provided with the upper draw-out motor 17, and the upper pinion 171 rotating by the upper draw-out motor 17 may protrude upward so as to be gear-coupled to an upper draw-out rack 64 disposed on a bottom surface of the upper drawer door 60. Also, a door restriction device 70 may be provided on the partition member 18. The door restriction device 70 may be mounted on a rear surface of the partition member 18 and may be selectively hooked with the door restriction part 65 protruding from a bottom surface of the upper drawer door 60.

In detail, the door restriction device 70 may include a restriction device case 75 and a slider 73 accommodated in the restriction device case 75, and a push member 76.

The restriction device case 75 may include a slider accommodation part 751 in which the slider 73 is accommodated and an inclined part accommodation in which the elastic member 74 and the inclined part 761 of and the push member are accommodated.

The slider accommodation part 751 may guide the slider 73 to move in the vertical direction, and an upper end of the slider accommodation part 751 may be opened to allow the upper end of the slider 73 to be inserted and withdrawn.

Also, the inclined part accommodation part 752 may extend in a direction crossing the slider accommodation part 751 and may have an opened rear end to allow the horizontal extension part 762 of the push member 76 to be inserted and withdrawn. The inclined part 761 accommodated inside the inclined part accommodation part 752 may be configured to pass through the slider 73 from the inside of the inclined part 761. Also, the inclined part accommodation part 752 may have a sufficient space to allow the inclined part 761 to move forward and backward. Thus, the slider 73 may move vertically along the inclination of the inclined part 761 when the inclined part 761 moves forward and backward.

Also, a second elastic member fixing part 761*a* may be provided on the lower end of the inclined part 761. Also, the first elastic member fixing part 752*a* may be provided on one side of the restriction device case 75 separated from the second elastic member fixing part 761*a*. The elastic member 74 may be provided inside the restriction device case 75 and have both ends fixed to the first elastic member fixing part 752*a* and the second elastic member fixing part 761*a*, 761. When the external force is removed, the inclined part 761 may move forward.

The push member 76 may include the inclined part 761, the horizontal extension part 762, and the vertical extension part 763. The inclined part 761 may be provided to be movable forward and backward inside the inclined part accommodation part 752 and have an inclination that gradually increases backward. When the inclined part 761 moves backward, the slider 73 may be lifted upward.

Also, the horizontal extension part 762 extending backward through the restriction device case 75 may be disposed on the rear end of the inclined part 761. The horizontal extension part 762 may extend to a position corresponding to the rear end of the lower drawer door 30 in a state in which the lower drawer door 30 is closed. The horizontal extension part 762 may extend to another position at which the lower drawer door 30 is pressed while the pusher member 76 is closed.

The vertical extension part 763 may extend vertically downward from the rear end of the horizontal extension part 762 and contact the rear end of the lower drawer door 30. Also, a contact part 764 may be disposed on the lower end of the vertical extension part 763 to facilitate the contact with the lower drawer door 30. The contact part 764 may have an area greater than that of the vertical extension part 763.

Also, each of the vertical extension part 763 and the horizontal extension part 762 may have a bar shape having predetermined strength. When the rear end of the lower drawer door 30 and the contact part 764 contact each other, the entire push member 76 may move by the lower drawer door 30.

Thus, as illustrated in FIG. 24, when the lower drawer door 30 is closed, the rear end of the lower drawer door 30 may contact the contact part 764 of the push member 76 to push the push member 76 backward.

In this state, the inclined part 761 may be disposed at the rearmost position, and the elastic member 74 may be in the maximal tensioned state. Also, the slider 73 may be disposed at the lowest position, and the upper end of the slider 73 may be disposed below the door restriction part 65 so that the upper drawer door 60 is not restrained. Thus, the upper drawer door 60 may be freely inserted and withdrawn.

Thus, as illustrated in FIG. 25, when the lower drawer door 30 is opened, the rear end of the lower drawer door 30 may be separated from the contact part 764 of the push member 76, and the push member 76 may move forward by the elastic member 74.

That is, the inclined part 761 may move forward in the inclined part accommodation part 752, and the slider 73 may move upward along the inclined part 761. When the slider 73 moves to the uppermost position, the upper end of the slider 73 may be restricted with the door restriction part 65. Thus, in the state in which the lower drawer door 30 is withdrawn for the elevation, the upper drawer door 60 may be restricted and not be opened.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 26:
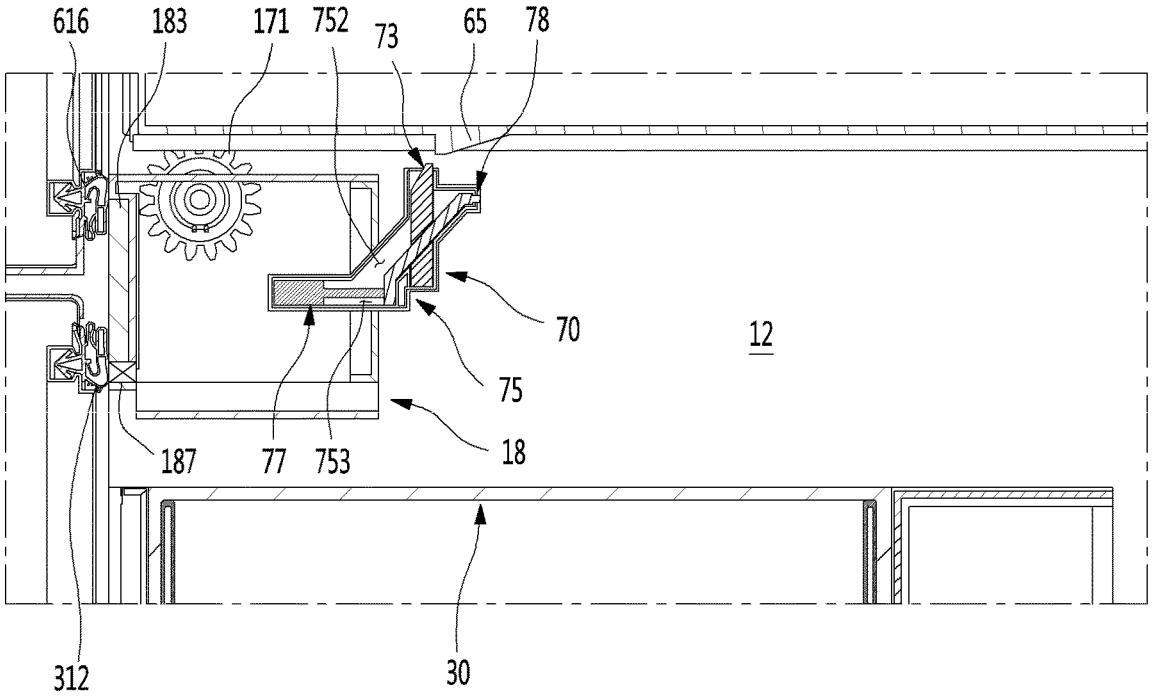
FIG. 26 is a view illustrating a state in which a drawer door of a refrigerator is closed according to another embodiment.
Figure 27:
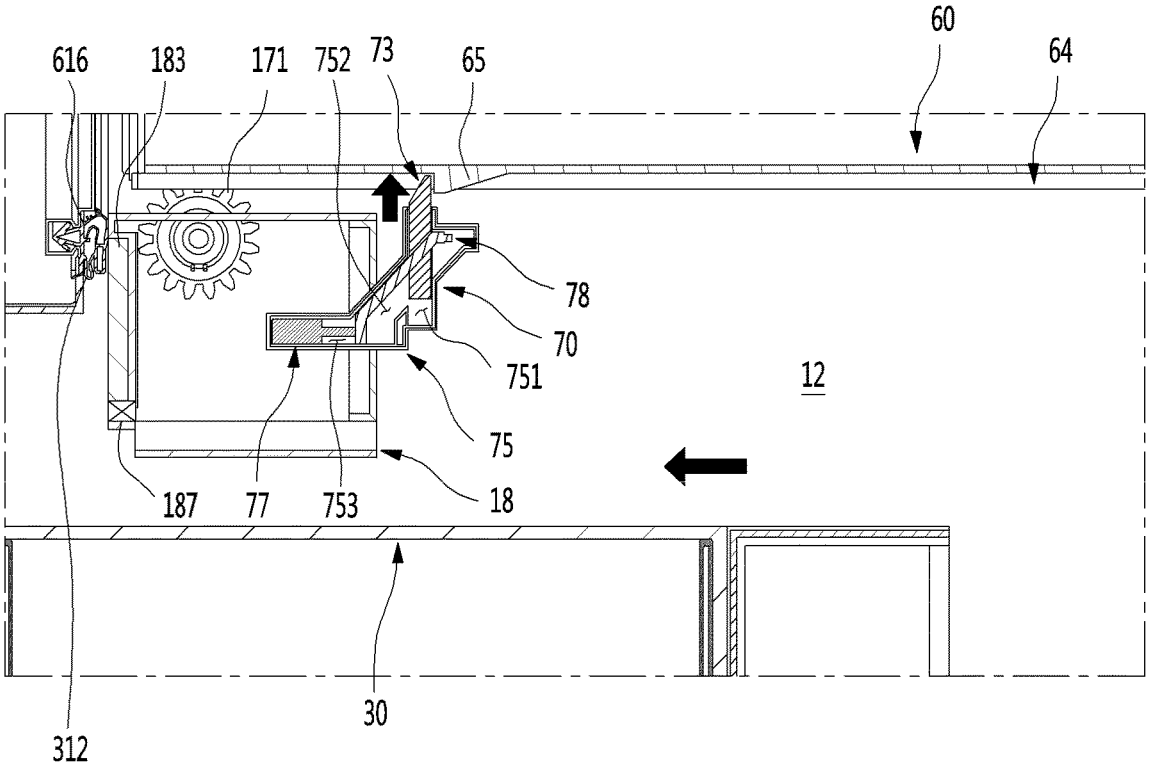
FIG. 27 is a view illustrating a state in which the drawer door of the refrigerator is opened.

FIG. 26 is a view illustrating a state in which a drawer door of a refrigerator is closed according to another embodiment. FIG. 27 is a view illustrating a state in which the drawer door of the refrigerator is opened.

As illustrated in the drawings, a refrigerator 1 according to another embodiment may include a cabinet 10 in which a storage space 12 is defined. Also, an upper drawer door 60 and a lower drawer door 30 may be vertically disposed in the storage space 12 of the cabinet 10, the upper drawer door 60 and the lower drawer door 30 may be provided at a front end of the storage space 12, and a partition member 18 contacting the upper drawer door 60 and the lower drawer door 30 in a closed state may be provided.

The partition member 18 may be provided with the upper draw-out motor 17, and the upper pinion 171 rotating by the upper draw-out motor 17 may protrude upward. Also, a door detection device 187 and a door restriction device 70 may be provided on the partition member 18.

The door detection device 187 may be disposed on a front surface of the partition member 18 to contact the rear surface of the lower drawer door 30. When the lower drawer door 30 is closed, the door detection device 187 may contact the rear surface of the lower drawer door 30 to recognize that the lower drawer door 30 is closed. When the lower drawer door 30 is opened, the lower drawer door 30 is separated from the rear surface of the lower drawer door 30, thereby recognizing that the lower drawer door 30 is opened.

The door restriction device 70 may be mounted on a rear surface of the partition member 18 and may be selectively hooked with the door restriction part 65 protruding from a bottom surface of the upper drawer door 60 according to a detected signal of the door detection device 187.

In detail, the door restriction device 70 may include a slider 73, a push member 78, and an actuator 77, which are accommodated in the restriction device 70.

The restriction device case 75 may include a slider accommodation part 751 in which the slider 73 is accommodated, a push member accommodation part 752 in which the push member 78 is accommodated, and an actuator accommodation part 753 in which the actuator 77 is accommodated.

The slider accommodation part 751 may guide the slider 73 to move in the vertical direction, and an upper end of the slider accommodation part 751 may be opened to allow the upper end of the slider 73 to be inserted and withdrawn.

Also, the push member accommodation part 752 may accommodate the push member 78 which extends in a direction crossing the slider accommodation part 751 and is inclinedly disposed.

The push member 78 accommodated in the push member accommodation part 752 may be configured to pass through the slider 73 from the inside of the push member accommodation part 752. Also, the push member 78 may have an inclination that increases backward.

Also, the push member accommodation part 752 may have a sufficient space to allow the push member 78 to move forward and backward. Thus, the slider 73 may move vertically along the inclination of the push member 78 when the push member 78 moves forward and backward.

Also, the actuator 77 may be provided on the lower end of the push member 78. The actuator 77 may be provided in the actuator accommodation part 753 communicating with the push member accommodation part 752. The actuator 77 may be provided as a solenoid valve, and the push member 78 may be pushed or pulled to move forward and backward. The actuator 77 may have various other structures capable of moving the push member 78.

The actuator 77 may be operated according to the detected signal of the door detection device. That is, as illustrated in FIG. 26, when the lower drawer door 30 is recognized as being closed from the door detection device 187, the actuator 77 may be operated so that the push member 78 is disposed at the rearmost position, and the slider 73 may move along the inclination of the push member 78 and disposed at the lowest position. Here, the upper end of the slider 73 may be disposed below the door restriction part 65 so that the upper drawer door 60 is not restrained. Thus, the upper drawer door 60 may be freely inserted and withdrawn.

That is, as illustrated in FIG. 27, when the lower drawer door 30 is recognized as being opened from the door detection device 187, the actuator 77 may be operated so that the push member 78 is disposed at the front most position, and the slider 73 may move along the inclination of the push member 78 and disposed at the highest position.

That is, when the slider 73 moves to the uppermost position, the upper end of the slider 73 may be restricted with the door restriction part 65. Thus, in the state in which the lower drawer door 30 is withdrawn for the elevation, the upper drawer door 60 may be restricted and not be opened.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 28:
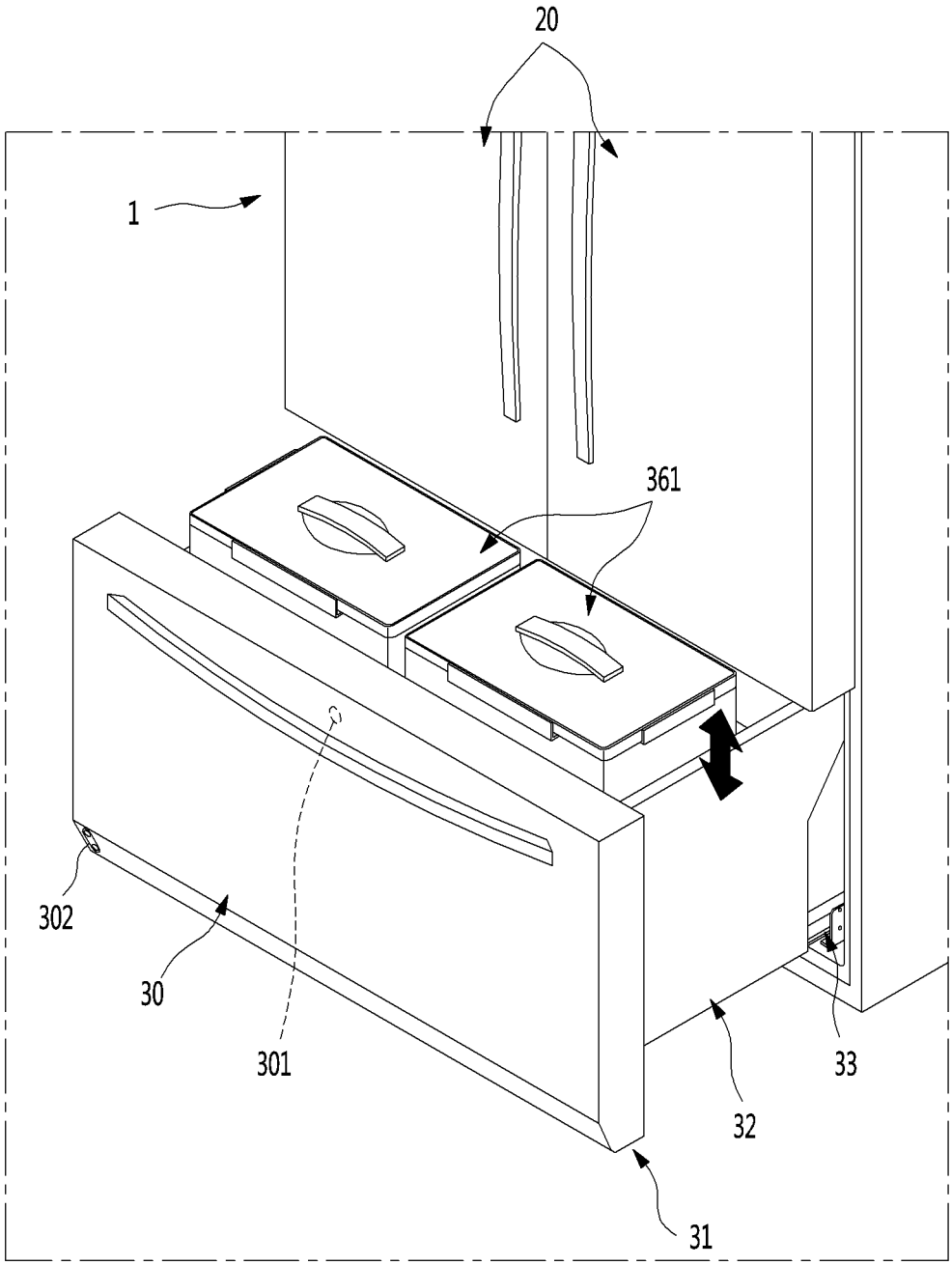
FIG. 28 is a perspective view of a refrigerator according to another embodiment.
Figure 29:
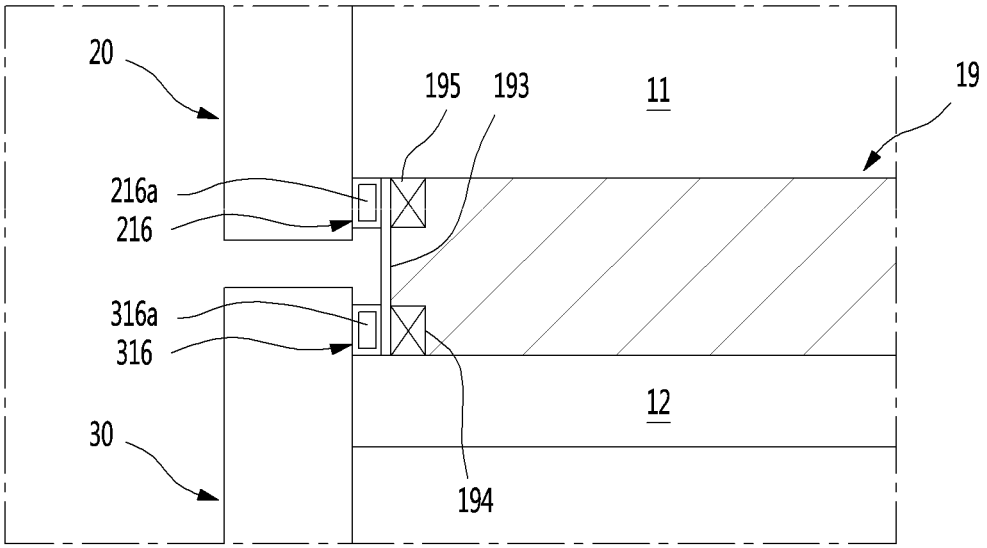
FIG. 29 is a partial cross-sectional view of a refrigerator according to another embodiment.

FIG. 28 is a perspective view of a refrigerator according to another embodiment. Also, FIG. 29 is a partial cross-sectional view of a refrigerator according to another embodiment.

As illustrated in the drawing, a refrigerator 1 according to another embodiment may include a cabinet 10 having a storage space that is vertically partitioned and a door opening and closing the storage space.

The door may include a rotation door 20 which is provided in an upper portion of a front surface of the cabinet 10 to open and close an upper storage space and a drawer door 30 disposed in a lower portion of the front surface of the cabinet 10 to open and close a lower storage space.

A space in which the rotation door 20 and the drawer door 30 are provided may be completely divided by the partition member 19 to define an upper storage space 11 and a lower storage space 12, respectively. Also, the rotation door 20 and the drawer door 30 may contact the front surface of the partition member 19 in a closed state. Here, a front plate 193 made of a metal material may be disposed on the front surface of the partition member 19, and gaskets 216 and 316 may be provided on the rear surface of the rotation door 20 and the drawer door 30. Also, magnets 216*a* and 316*a* may be provided in the gaskets 216 and 316 contacting the front plate 193. Thus, the rotation door 20 and the drawer door 30 may seal the upper storage space 11 and the lower storage space 12 in a closed state.

The drawer door 2 may be inserted and withdrawn forward and backward like the foregoing embodiment. In the state in which the drawer door 2 is withdrawn, the support member 35 within the drawer door 2 may be vertically elevated.

A manipulation part 301 or a manipulation device 302 may be provided at one side of the door part 31. The insertion and withdrawal of the drawer door 2 and/or the elevation of the support member 35 may be realized by manipulating the manipulation part 301 or the manipulation device 302.

The support member 35 may be provided in the drawer part 32. The support member 35 may be elevated by driving the elevation assembly provided in the door part 31 and the drawer part 32. Since the structure of the drawer door 2 and the structure of the elevation assembly 40 are the same as those according to the foregoing embodiment, their detailed descriptions will be omitted.

A plurality of containers 361 may be provided in the support member 35. The container 361 may be a sealed container such as a kimchi passage, and a plurality of the containers 361 may be seated on the support member 35. The container 361 may be elevated together with the support member 35 when the support member 35 is elevated. Thus, in the state in which the container 361 ascends, at least a portion of the drawer part 32 may protrude, and thus, the user may easily lift the container 361.

The door detection device 194 may be provided at a position facing the drawer door 30 on the inside of the partition member 19. The door detection device 194 may detect whether the drawer door 30 is in a closed state or an open state. The door detection device 194 may be a contact type switch or sensor and may be a sensor for sensing the magnet.

Also, a door restriction device 195 may be provided on the inner side of the partition member 19 at a position facing the rotation door 20. The door restriction device 195 may determine that the drawer door 30 is opened without restricting the rotation door 20 when it is determined that the drawer door 30 is closed according to a signal of the door detection device 194, and thus, the rotation door 20 may be restricted.

The door restriction device 195 may be provided as an electromagnet to restrict one side of the rotation door 20 or the gaskets 316 and 216 by magnetic force. Of course, the door restriction device 195 may mechanically restrict the rotation door 20 as in the above-described embodiments. Also, the door restriction device 195 may be provided at a position adjacent to the hinge or the hinge connecting the rotation door 20 to the cabinet 10 for rotation of the rotation door 20 rather than the partition member 19 and may be provided in the rotation door 20 or the cabinet 10 facing the rotation door 20 to restrict the rotation door.

As described above, the opening of the rotation door 20 may be restricted in the state in which the drawer door 30 is withdrawn and elevated so that the container or the food in the drawer door 30 is prevented from being damaged by the opening of the rotation door 20.

The following effects may be expected in the refrigerator according to the proposed embodiments.

The refrigerator according to the embodiment, the portion of the storage space within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the support member within the drawer door may ascend up to a convenient position by driving the elevation assembly to prevent the user from being injured and significantly improve the convenience in use.

Also, the support member on which the food or the container is seated may be disposed in the drawer door, and the elevation assembly may be provided on both the sides of the drawer door to elevate the support member. Thus, the support member may be elevated in the state in which both ends of the support member are supported. Thus, the support member may be prevented from being eccentric or tilted to secure the stable elevation and the operation reliability.

Also, when the lower drawer door of the drawer doors that are vertically disposed is withdrawn, the upper drawer door of the drawer doors may be restricted by the door restriction device and thus may not be withdrawn.

Thus, even if the lower drawer door is withdrawn to be elevated and then elevated in the state of being withdrawn, the upper drawer door may be maintained in the closed state, and its opening may be restricted to prevent a safety accident and damage of the drawer door from occurring and also prevent the foods stored in the lower drawer door or the upper drawer door from being damaged by colliding with the upper drawer door.

Also, the door restriction device may be configured to restrict the upper drawer door at the same time when the lower drawer door is opened, and the withdrawal of the upper drawer door may be restricted only by the operation of the withdrawal of the lower drawer door without any other operation, and the upper drawer door may be withdrawn only by closing the lower drawer door to improve the convenience in use and secure the operational reliability.

Also, the door restriction device may mechanically operate by the push member contacting the lower door and the slider interlocked with the push member to restrict the upper drawer door. Thus, the operation delay by the electronic device may be prevented to secure the immediate operation and prevent the malfunction from occurring, thereby realizing the reliable operation. Also, the power supply and the signal transmission may be unnecessary to improve the assembly and the serviceability.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a storage space;

an upper door configured to open and close a first portion of the storage space;

a lower door located vertically below the upper door and configured to open and close a second portion of the storage space, the lower door being configured to insert into and withdraw from the second portion of the storage space;

a draw-out rail that connects the lower door to the storage space and that is configured to guide insertion and withdrawal of the lower door in a forward direction and a rearward direction;

an elevation assembly located at the lower door and configured to, in a state in which the lower door is withdrawn from the second portion of the storage space, elevate an object stored in a drawer space defined in the lower door, the elevation assembly being configured to elevate the object relative to a bottom surface of the lower door;

a partition member that is located between the upper door and the lower door and that extends across a front end of the storage space in a horizontal direction to thereby define the first portion of the storage space and the second portion of the storage space;

a door detection device configured to detect whether the lower door is opened or closed;

a door restriction device located at the partition member and configured to selectively restrict an opening movement of the upper door; and an actuator configured to operate the door restriction device based on detection by the door detection device of whether the lower door is opened or closed.

2. The refrigerator according to claim 1, wherein the door detection device is located at the partition member.

3. The refrigerator according to claim 2, wherein the lower door is located forward of a front surface of the partition member, the lower door having a rear surface configured to contact the front surface of the partition member based on the lower door being closed.

4. The refrigerator according to claim 1, wherein the door restriction device comprises:

a restriction device case;

a push member accommodated in the restriction device case and configured to move in the forward and rearward directions; and a slider accommodated in the restriction device case, the slider being configured to:

based on the push member moving in the forward direction, move upward in a vertical direction to thereby restrict the opening movement of the upper door, and based on the push member moving in the rearward direction, move downward in the vertical direction to thereby allow the opening movement of the upper door.

5. The refrigerator according to claim 4, wherein the restriction device case is located in the partition member, and wherein a portion of the restriction device case protrudes outside of partition member.

6. The refrigerator according to claim 4, wherein the actuator is located inside of the restriction device case, and wherein the actuator is configured to move the push member based on a signal from the door detection device regarding whether the lower door is opened or closed.

7. The refrigerator according to claim 4, wherein the push member is configured to move in the forward and rearward directions based on operation of the actuator.

8. The refrigerator according to claim 4, wherein the push member is configured to:

move in the rearward direction based on the actuator moving in the rearward direction; and move in the forward direction based on the actuator moving in the forward direction.

9. The refrigerator according to claim 4, wherein the upper door comprises:

a drawer that is configured to insert into and withdraw from the first portion of the storage space in the forward and rearward directions; and a door restriction protrusion that protrudes downward from a bottom surface of the drawer and that is configured to interfere with the slider in a state in which the upper door is closed.

10. The refrigerator according to claim 9, wherein the door restriction protrusion is configured to be located rearward of the slider based on the upper door being closed.

11. The refrigerator according to claim 9, wherein the slider is configured to:

based on moving downward in the vertical direction, insert into an inside of the restriction device case and move away from the door restriction protrusion; and based on moving upward in the vertical direction, protrude outward from the restriction device case and contact the door restriction protrusion in a state in which a bottom surface of the slider is spaced apart from a lower surface of the restriction device case.

12. The refrigerator according to claim 4, wherein the restriction device case comprises:

a push member accommodation part that accommodates the push member and that defines a space for the push member to move in the forward and rearward directions; and a slider accommodation part connected to the push member accommodation part and inclined with respect to the push member accommodation part, the slider accommodation part defining a space for the slider to move in the vertical direction.

13. The refrigerator according to claim 12, wherein the restriction device case further comprises a movement guide that protrudes from an inner surface of the push member accommodation part in the rearward direction, and wherein the push member defines a guide groove configured to receive the movement guide and to guide movement of the push member along the movement guide.

14. The refrigerator according to claim 4, wherein the push member extends in the rearward direction toward the storage space and is inclined upward toward the upper door, and wherein the slider defines a through-hole that receives the push member, that extends along the push member, and that is inclined with respect to the forward and rearward directions.

15. The refrigerator according to claim 1, wherein the partition member is configured to:

contact a rear surface of the upper door based on the upper door being closed; and contact a rear surface of the lower door based on the lower door being closed.

16. The refrigerator according to claim 1, wherein the partition member comprises:

a partition member case that defines an exterior of the partition member and that receives at least a portion of the door restriction device;

an insulation material provided in the partition member case; and a front plate that defines a front surface of the exterior of the partition member.

17. The refrigerator according to claim 16, wherein the door restriction device passes through a rear surface of the partition member case and is located rearward of the partition member.

18. The refrigerator according to claim 1, wherein the upper door is rotatably coupled to the cabinet and configured to open and close the first portion of the storage space based on rotating relative to the cabinet.

19. The refrigerator according to claim 1, wherein the lower door comprises:

a drawer part configured to insert into and withdraw from the second portion of the storage space, the drawer part defining an opening at an upper surface; and a door part coupled to a front surface of the drawer part and configured to, based on the drawer part inserting into and withdrawing from the second portion of the storage space, close and open a front side of the second portion of the storage space, and wherein the elevation assembly is configured to elevate the object through the opening at the upper surface of the drawer part.

20. The refrigerator according to claim 19, wherein the elevation assembly comprises:

a support member located inside of the drawer part and configured to seat the object stored in the lower door;

a drawer-side device that is located at side surfaces of the drawer part, that is coupled to the support member, and that is configured to elevate the support member relative to the drawer part; and a door-side device located inside of the door part and configured to supply power to the drawer-side device.

* * * * *